US012624527B2

(12) United States Patent
Hirate et al.

(10) Patent No.: US 12,624,527 B2
(45) Date of Patent: May 12, 2026

(54) WORK MACHINE AND REMOTE OPERATION SUPPORT DEVICE

(71) Applicant: SUMITOMO HEAVY INDUSTRIES, LTD., Tokyo (JP)

(72) Inventors: Shoji Hirate, Kanagawa (JP); Keiji Honda, Kanagawa (JP); Yusuke Sano, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 188 days.

(21) Appl. No.: 18/396,782

(22) Filed: Dec. 27, 2023

(65) Prior Publication Data

US 2024/0218632 A1 Jul. 4, 2024

(30) Foreign Application Priority Data

Dec. 28, 2022 (JP) ..... 2022-211228

(51) Int. Cl.
*E02F 9/20* (2006.01)
*E02F 9/26* (2006.01)

(52) U.S. Cl.
CPC ..... *E02F 9/205* (2013.01); *E02F 9/262* (2013.01)

(58) Field of Classification Search
CPC ... E02F 9/205; E02F 9/262; E02F 9/24; E02F 9/26; E02F 9/2004; E02F 9/2264; E02F 9/2267; E02F 3/28; E02F 3/36; E02F 3/43
See application file for complete search history.

(56) References Cited

U.S. PATENT DOCUMENTS

| | | | | |
|---|---|---|---|---|
| 9,982,415 | B2 * | 5/2018 | Yamada | G05D 1/0276 |
| 11,746,497 | B2 * | 9/2023 | Shiratani | E02F 9/2242 414/699 |
| 12,305,366 | B2 * | 5/2025 | Yamamoto | F15B 11/17 |
| 2010/0250023 | A1 | 9/2010 | Gudat | |
| 2022/0042283 | A1 * | 2/2022 | Tsuji | E02F 3/32 |
| 2022/0341124 | A1 * | 10/2022 | Sugiyama | E02F 3/425 |
| 2023/0279640 | A1 * | 9/2023 | Sasaki | G08C 17/00 701/2 |
| 2024/0017970 | A1 * | 1/2024 | Yamamoto | E02F 3/962 |
| 2024/0159024 | A1 * | 5/2024 | Kanda | E02F 9/267 |
| 2025/0179762 | A1 * | 6/2025 | Tsuzuki | E02F 3/437 |

FOREIGN PATENT DOCUMENTS

| | | |
|---|---|---|
| EP | 4043646 | 8/2022 |
| JP | 2022-182529 | 12/2022 |

* cited by examiner

*Primary Examiner* — Russell Frejd
(74) *Attorney, Agent, or Firm* — IPUSA, PLLC

(57) ABSTRACT

A work machine includes an actuator; an operator's seat; an operation device configured to receive an input by a first operator in the operator's seat to operate the actuator; processing circuitry configured to activate the actuator according to one of an input of a remote operation from outside the work machine and an input to the operation device; and an output device configured to perform at least one of notifying the first operator that the work machine is being remotely operated when the actuator is being activated according to the input of the remote operation, and notifying the first operator that there is a possibility of the work machine being remotely operated when there is a possibility of the actuator being activated according to the input of the remote operation.

10 Claims, 11 Drawing Sheets

WORK MACHINE AND REMOTE OPERATION SUPPORT DEVICE

CROSS-REFERENCE TO RELATED APPLICATIONS

This application is based upon and claims priority to Japanese Patent Application No. 2022-211228, filed on Dec. 28, 2022, the entire contents of which are incorporated herein by reference.

BACKGROUND

1. Technical Field

The present disclosure relates to a work machine, and the like.

2. Description of Related Art

For example, a work machine (e.g., a shovel) is known that can be operated by an operator on board the work machine and can be remotely operated by an operator outside the work machine.

SUMMARY

In order to achieve the above object, according to an embodiment of the present disclosure, a work machine is provided. The work machine includes:

an actuator;

an operator's seat;

an operation device configured to receive an input by a first operator in the operator's seat to operate the actuator;

processing circuitry configured to activate the actuator according to one of an input of a remote operation from outside the work machine and an input to the operation device; and an output device configured to perform at least one of notifying the first operator that the work machine is being remotely operated when the actuator is being activated according to the input of the remote operation, and notifying the first operator that there is a possibility of the work machine being remotely operated when there is a possibility of the actuator being activated according to the input of the remote operation.

According to another embodiment of the present disclosure, a remote operation support device is provided. The remote operation support device includes:

a communication device configured to communicate with a work machine in which an actuator is operated according to one of an input to an operation device provided near an operator's seat of the work machine and an input of a remote operation from outside the work machine; and an output device configured to perform at least one of notifying a third operator who performs the input of the remote operation that the work machine is being operated according to the input to the operation device when the actuator is being operated according to the input to the operation device, and notifying the third operator that there is a possibility of the work machine being operated according to the input to the operation device when there is a possibility of the actuator being operated according to the input to the operation device.

DETAILED DESCRIPTION

In a case where an operator in an operator's seat of a work machine and an operator outside the work machine are, for example, both able to activate the work machine, the work machine may be activated by operation by one of the operators in a situation that is unexpected by the other operator. This may result in activation of the work machine that is unexpected by the other operator, who may misunderstand that the work machine is in a serious failure or the like and may fall into a panic state, for example.

Accordingly, it is desirable to provide a technique for enabling one of the operators to recognize an operation status of the work machine that is performed by the other operator when an operation by the operator on board the work machine and a remote operation by the operator outside the work machine are possible.

According to the above-described embodiments, a technique is provided for enabling one of the operators to recognize an operation status of a work machine by the other operator when the operation by the operator on board the work machine and the remote operation by the operator outside the work machine are both possible.

Hereinafter, embodiments will be described with reference to the accompanying drawings.

[Overview of Remote Operation Support System]

An overview of a remote operation support system SYS according to a present embodiment will be described with reference to FIGS. 1 to 5.

Figure 1:
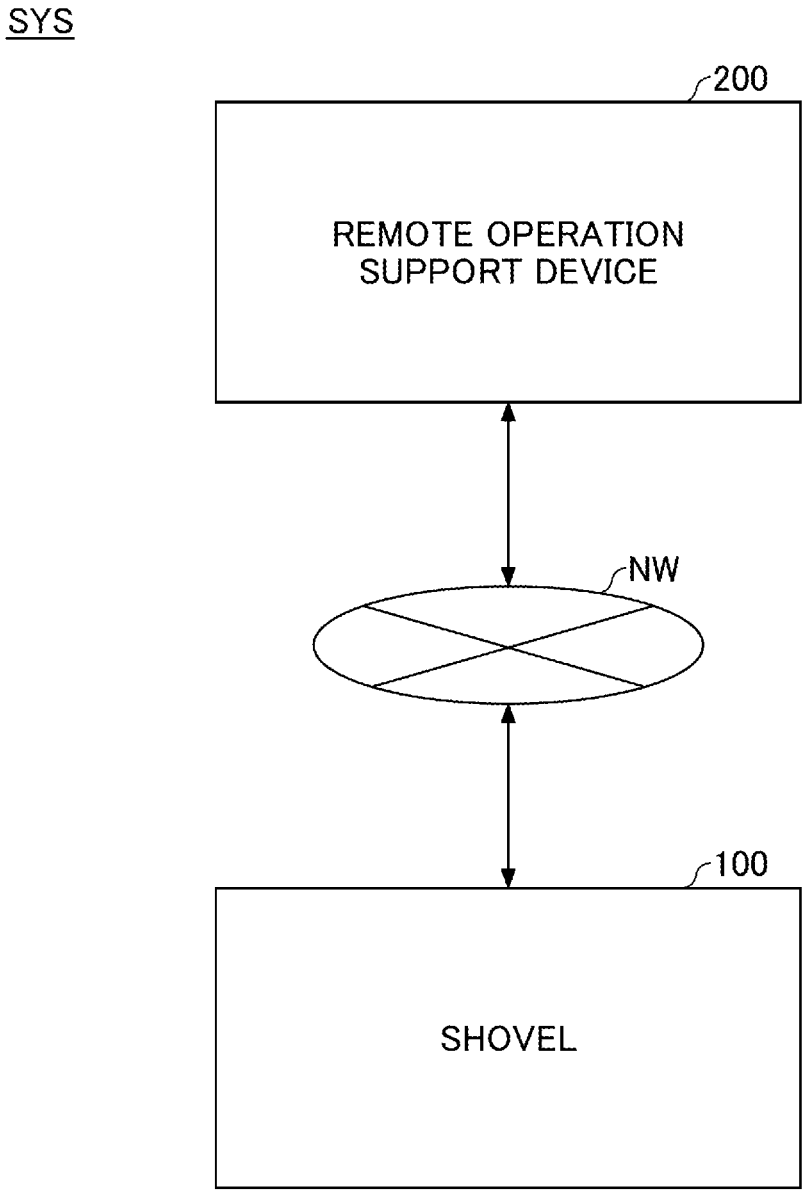
FIG. 1 is a diagram illustrating an example of a remote operation support system.
Figure 2:
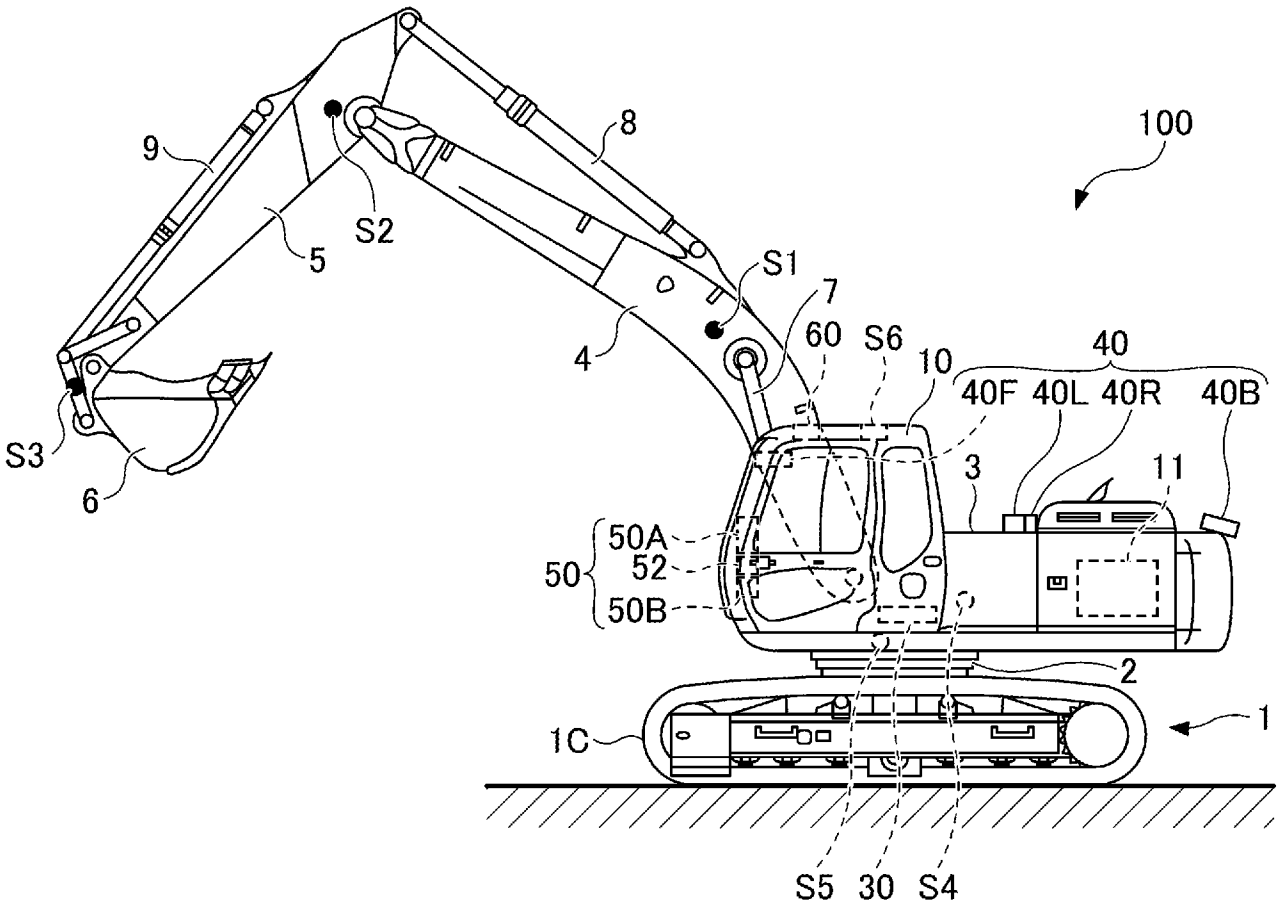
FIG. 2 is a side view illustrating an example of a shovel.
Figure 3:
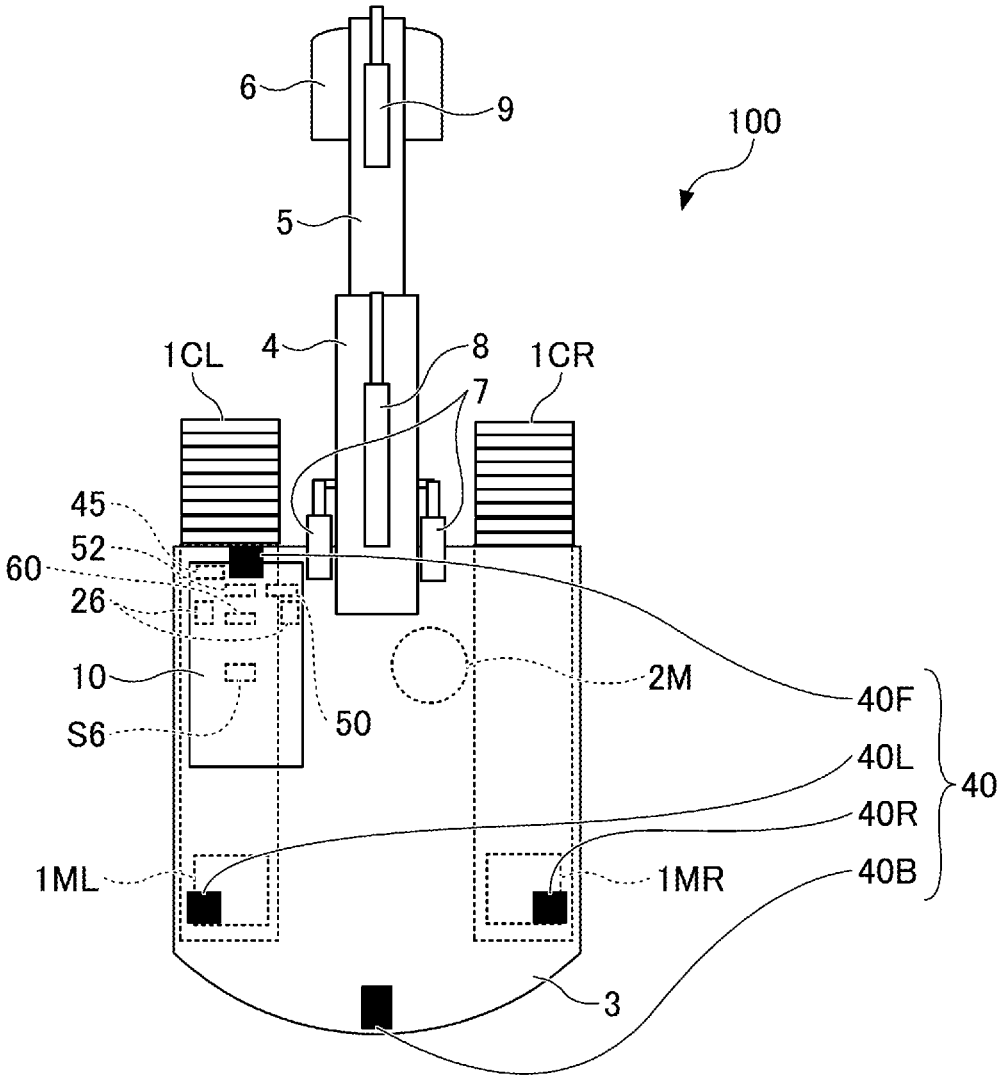
FIG. 3 is a top view illustrating an example of the shovel.
Figure 4:
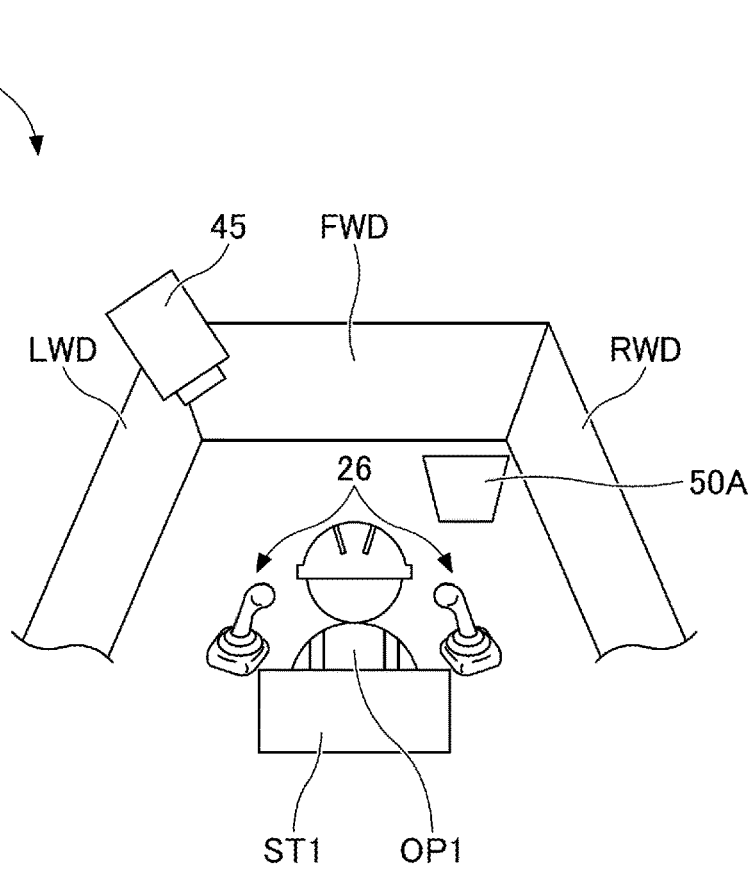
FIG. 4 is a schematic view illustrating an example of the inside of an operator's seat.
Figure 5:
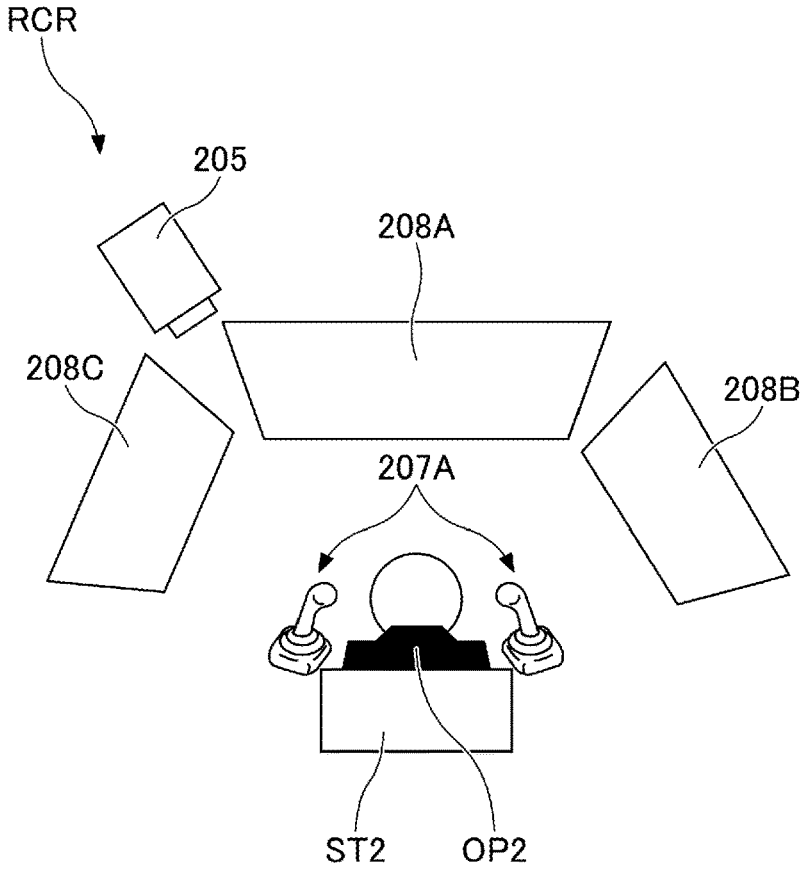
FIG. 5 is a schematic view illustrating an example of the inside of a remote control room.

FIG. 1 is a diagram illustrating an example of the remote operation support system SYS. FIG. 2 is a side view illustrating an example of a shovel 100. FIG. 3 is a top view illustrating an example of the shovel 100. FIG. 4 is a schematic view illustrating an example of the interior of a cabin 10. FIG. 5 is a schematic view illustrating an example of the inside of the remote control room RCR. Hereinafter, a direction in the shovel 100 or a direction viewed from the shovel 100 may be described by defining a direction in which an attachment AT extends in a top view of the shovel 100 (an upper direction in FIG. 3) as "front".

As illustrated in FIG. 1, the remote operation support system SYS includes a shovel 100 and a remote operation support device 200.

The remote operation support system SYS supports remote operation of the shovel 100 by an operator outside the shovel 100 using the remote operation support device 200.

The remote operation support system SYS may support remote operation of the shovel 100 by an operator outside another work machine different from the shovel 100. For example, the other work machine is a crawler crane, a bulldozer, or the like.

<Overview of Shovel>

As illustrated in FIGS. 2 and 3, the shovel 100 includes a lower traveling body 1, an upper turning body 3, an attachment AT including a boom 4, an arm 5, and a bucket 6, and a cabin 10.

The lower traveling body 1 causes the shovel 100 to travel by using the crawler 1C. The crawler 1C includes a left crawler 1CL and a right crawler 1CR. The crawler 1CL is hydraulically driven by a traveling hydraulic motor 1ML. Similarly, the crawler 1CR is hydraulically driven by a traveling hydraulic motor 1MR. Thus, the lower traveling body 1 can travel by itself.

The upper turning body 3 is turnably (swingably) mounted on the lower traveling body 1 via a turning mechanism 2. For example, the upper turning body 3 turns with respect to the lower traveling body 1 by the turning mechanism 2 being hydraulically driven by the turning hydraulic motor 2M.

The boom 4 is attached to the center of a front portion of the upper turning body 3 so as to be able to be elevated and lowered about a rotation axis along a left-right direction. The arm 5 is attached to a tip end of the boom 4 so as to be rotatable about a rotation axis along the left-right direction. The bucket 6 is attached to a tip end of the arm 5 so as to be rotatable about a rotation axis along the left-right direction.

The bucket 6 is an example of an end attachment, and is used for, for example, excavation work, slope work, and leveling work.

The bucket 6 is attached to a tip end of the arm 5 such that the bucket 6 can be appropriately replaced according to the work content of the shovel 100. That is, instead of the bucket 6, a different type of bucket, such as a relatively large bucket, a slope bucket, a dredging bucket, or the like, may be attached to the tip end of the arm 5. Further, the end attachment of a type other than the bucket, for example, a stirrer, a breaker, a crusher, or the like may be attached to the tip end of the arm 5. Further, for example, a spare attachment, such as a quick coupling or a tilt rotator, may, for example, be provided between the arm 5 and the end attachment.

The boom 4, the arm 5, and the bucket 6 are hydraulically driven by a boom cylinder 7, an arm cylinder 8, and a bucket cylinder 9, respectively.

The cabin 10 is a control room for an operator to board and operate the shovel 100. The cabin 10 is mounted on, for example, the left side of the front portion of the upper turning body 3.

The shovel 100 includes a communication device 60. Thus, the shovel 100 can communicate with the remote operation support device 200 through a predetermined communication line NW. For example, the shovel 100 transmits various kinds of information acquired or generated by the shovel 100 itself to the remote operation support device 200, and shares the information. The shovel 100 may receive a signal (hereinafter, referred to as a "remote operation signal") indicating the content of the operation input relating to the remote operation of the shovel 100 performed by the remote operation support device 200 through the communication line NW.

The communication line NW includes, for example, a local area network (LAN) at a work site. The communication line NW may include a wide area network (WAN). The wide area networks include, for example, mobile communication networks having base stations as terminals, satellite communications networks using communication satellites, and the Internet networks. The communication line NW may include a near field communication line based on wireless communication standards such as WiFi and Bluetooth (registered trademark).

The shovel 100 can operate driven elements such as the lower traveling body 1 (that is, the pair of left and right crawlers 1CL and 1CR), the upper turning body 3, the boom 4, the arm 5, and the bucket 6 in response to an operation of an operator who boards the cabin 10.

For example, as illustrated in FIG. 4, an operator OP1 sits on the operator's seat ST1 in the cabin 10. The operator OP1 operates the shovel 100 using an operation device 26 while checking the surroundings of the shovel 100 through a front window FWD, a left window LWD, and a right window RWD.

The shovel 100 is configured to be operable by an operator in the cabin 10 and to be remotely operable from the outside of the shovel 100. When the shovel 100 is being remotely operated, the inside of the cabin 10 may be unmanned. Hereinafter, a description will be given on the assumption that the operation of the operator includes at least one of an operation of the shovel 100 using the operation device 26 by an operator in the cabin 10 and a remote operation of the shovel 100 by an operator outside the shovel 100.

The shovel 100 may have a semi-automatic driving function based on an operation of an operator. The semi-automatic driving function is also referred to as an operation support type machine control (MC) function. The semi-automatic driving function is a function of automatically driving another driven element (actuator) in conjunction with a driven element (actuator) to be operated in response to an operation of the operator.

<Overview of Remote Operation Support Device>

The remote operation support device 200 is communicably connected to the shovel 100 through the communication line NW, and supports remote operation of the shovel 100 by an operator outside the shovel 100.

For example, the remote operation includes a mode in which the shovel 100 is operated by an input relating to an operation of the driven element (actuator) of the shovel 100 performed by the remote operation support device 200.

The remote operation may include a mode in which the shovel 100 is operated by a voice input, a gesture input, or the like from the outside to the shovel 100 by a person (for example, a worker) around the shovel 100. Specifically, the shovel 100 recognizes a voice uttered by a surrounding worker or the like, a gesture performed by the worker or the like, or the like through an audio input device (for example, a microphone), a gesture input device (for example, an imaging device), or the like mounted on the shovel 100. The shovel 100 may activate the actuators according to the recognized contents of the voice, the gesture, and the like, and drive the driven elements such as the lower traveling body 1 (the left and right crawlers 1C), the upper turning body 3, the boom 4, the arm 5, and the bucket 6.

The remote operation support device 200 is provided in a facility outside the work site, such as a management center that manages the work of the shovel 100 from the outside, for example. In this case, for example, as illustrated in FIG. 5, a remote control room RCR including an operator's seat ST2 for an operator OP2 outside the shovel 100 to remotely control the shovel 100 is provided in the facility in which the remote operation support device 200 is installed. For example, an operation device 207A and display devices 208A to 208C are provided in the remote operation room RCR. Then, the operator OP2 outside the shovel 100 sits in the operator's seat ST2 and performs remote operation of the shovel 100 using the operation device 207A while checking a real-time image of the surroundings of the shovel 100 displayed on the display devices 208A to 208C.

The remote operation support device 200 may be a portable operation terminal. In this case, the operator can remotely operate the shovel 100 while directly checking the work situation of the shovel 100 from the surroundings of the shovel 100.

For example, the shovel 100 transmits an image (hereinafter, referred to as a "surrounding image") representing a surrounding situation including the front of the shovel 100 based on the captured image output by an imaging device 40 mounted on the shovel 100 to the remote operation support device 200 through the communication device 60 mounted on the shovel 100. The shovel 100 may transmit the captured image output by the imaging device 40 to the remote operation support device 200 through the communication device 60, and the remote operation support device 200 may process the captured image received from the shovel 100 to generate the surrounding image. Then, the remote operation support device 200 may display the surrounding image representing the surrounding situation including the front of the shovel 100 on a display device 208 (for example, the display devices 208A to 208C) of the remote operation support device 200. Further, various information images (information screens) displayed on an output device 50 (a display device 50A) inside the cabin 10 may similarly be displayed on the display device 208 of the remote operation support device 200. Thus, the operator who uses the remote operation support device 200 may, for example, remotely operate the shovel 100 while checking the display content such as an image representing a surrounding situation of the shovel 100, an information screen, or the like displayed on the display device 208.

[Hardware Configuration of Remote Operation Support System SYS]

Next, a hardware configuration of the remote operation support system SYS will be described with reference to FIGS. 6 and 7 in addition to FIGS. 1 to 5.

<Hardware Configuration of Shovel>

Figure 6:
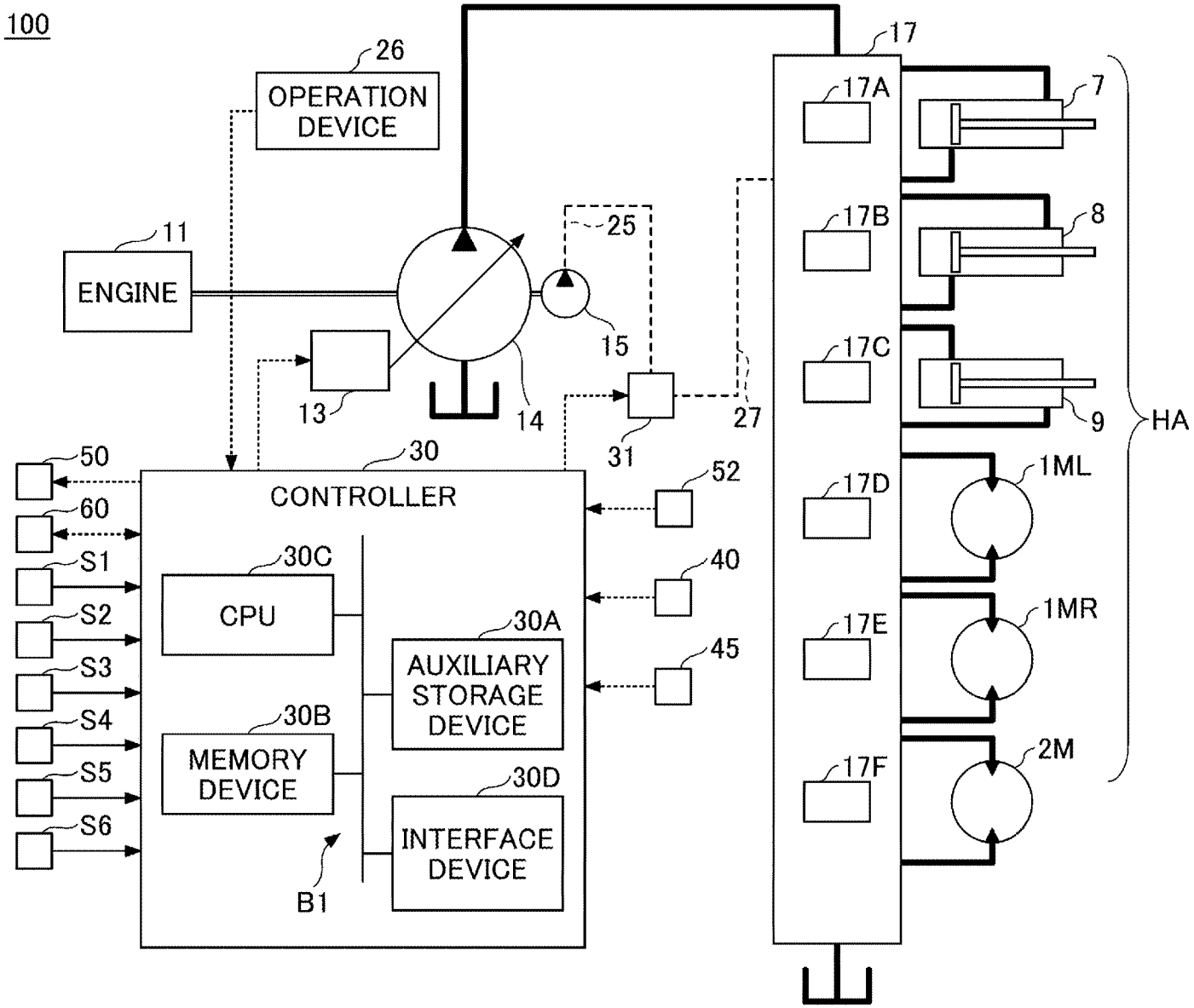
FIG. 6 is a diagram illustrating an example of a hardware configuration of the shovel.

FIG. 6 is a block diagram illustrating an example of a hardware configuration of the shovel 100.

In FIG. 6, a path through which mechanical power is transmitted is indicated by a double line, a path through which high-pressure hydraulic fluid for driving the hydraulic actuator flows is indicated by a solid line, a path through which a pilot pressure is transmitted is indicated by a broken line, and a path through which an electric signal is transmitted is indicated by a dotted line.

The shovel 100 includes respective components such as a hydraulic drive system relating to hydraulic drive of a driven element, an operation system relating to operation of the driven element, a user interface system relating to exchange of information with a user, a communication system relating to communication with the outside, and a control system relating to various controls.

<<Hydraulic Drive System>>

As illustrated in FIG. 6, the hydraulic drive system of the shovel 100 includes hydraulic actuators HA that hydraulically drive the driven elements such as the lower traveling body 1 (the left and right crawlers 1C), the upper turning body 3, the boom 4, the arm 5, and the bucket 6, as described above. The hydraulic drive system of the shovel 100 according to the present embodiment includes an engine 11, a regulator 13, a main pump 14, and a control valve 17.

The hydraulic actuators HA include traveling hydraulic motors 1ML and 1MR, a turning hydraulic motor 2M, a boom cylinder 7, an arm cylinder 8, a bucket cylinder 9, and the like.

In the shovel 100, a part or all of the hydraulic actuators HA may be replaced with electric actuators. That is, the shovel 100 may be a hybrid shovel or an electric shovel.

The engine 11 is a motor of the shovel 100 and is a main power source in the hydraulic drive system. The engine 11 is, for example, a diesel engine using light oil as fuel. The engine 11 is mounted on, for example, a rear portion of the upper turning body 3. The engine 11 rotates at a constant target rotation speed set in advance under direct or indirect control by a controller 30 described later, for example, and drives the main pump 14 and the pilot pump 15.

Note that, instead of or in addition to the engine 11, another motor (for example, an electric motor) or the like may be mounted on the shovel 100.

The regulator 13 controls (adjusts) the discharge amount of the main pump 14 under the control of the controller 30. For example, the regulator 13 adjusts the angle of a swash plate of the main pump 14 (hereinafter, referred to as "tilt angle") according to a control instruction from the controller 30.

The main pump 14 supplies a hydraulic fluid to the control valve 17 through a high-pressure hydraulic line. The main pump 14 is mounted, for example, on the rear portion of the upper turning body 3, similarly to the engine 11. The main pump 14 is driven by the engine 11 as described above. The main pump 14 is, for example, a variable displacement hydraulic pump. As described above, the stroke length of the piston is adjusted by adjusting the tilting angle of the swash plate by the regulator 13 under the control of the controller 30, and the discharge flow rate and the discharge pressure are controlled.

The control valve 17 drives the hydraulic actuator HA according to the content of the operation or remote operation of the operation device 26 by the operator or an operation instruction corresponding to the automatic driving function. The control valve 17 is mounted, for example, in a central portion of the upper turning body 3. As described above, the control valve 17 is connected to the main pump 14 via the high-pressure hydraulic line, and selectively supplies the hydraulic fluid supplied from the main pump 14 to each hydraulic actuator in response to an operation of the operator or an operation instruction corresponding to the automatic driving function. The control valve 17 includes directional control valves 17A to 17F that control the flow rate and the flow direction of the hydraulic fluid supplied from the main pump 14 to each of the hydraulic actuators HA.

The directional control valve 17A controls the flow rate and the flow direction of the hydraulic fluid supplied to the boom cylinder 7. Thus, the directional control valve 17A can extend and contract the boom cylinder 7 at a variable speed. The directional control valve 17A is, for example, a spool value.

The directional control valve 17B controls the flow rate and the flow direction of the hydraulic fluid supplied to the arm cylinder 8. Thus, the directional control valve 17B can extend and contract the arm cylinder 8 at a variable speed. The directional control valve 17B is, for example, a spool value.

The directional control valve 17C controls the flow rate and the flow direction of the hydraulic fluid supplied to the bucket cylinder 9. Thus, the directional control valve 17C can expand and contract the bucket cylinder 9 at a variable speed. The directional control valve 17C is, for example, a spool value.

The directional control valve 17D controls the flow rate and the flow direction of the hydraulic fluid supplied to the traveling hydraulic motor 1ML. Thus, the directional control valve 17D can rotate the traveling hydraulic motor 1ML in both directions at a variable speed. The directional control valve 17D is, for example, a spool value.

The directional control valve 17E controls the flow rate and the flow direction of the hydraulic fluid supplied to the traveling hydraulic motor 1MR. Thus, the directional control valve 17E can rotate the traveling hydraulic motor 1MR in both directions at a variable speed. The directional control valve 17E is, for example, a spool value.

The directional control valve 17F controls the flow rate and the flow direction of the hydraulic fluid supplied to the turning hydraulic motor 2M. Thus, the directional control valve 17F can rotate the turning hydraulic motor 2M in both directions at a variable speed. The directional control valve 17F is, for example, a spool value.

<<Operation System>>

As illustrated in FIG. 6, the operation system of the shovel 100 includes the pilot pump 15, the operation device 26, and a hydraulic control valve 31.

The pilot pump 15 supplies a pilot pressure to various hydraulic devices via a pilot line 25. The pilot pump 15 is mounted, for example, on the rear portion of the upper turning body 3, similarly to the engine 11. The pilot pump 15 is, for example, a fixed displacement hydraulic pump, and is driven by the engine 11 as described above.

The pilot pump 15 may be omitted. In this case, the hydraulic fluid at a relatively low pressure, which is obtained by reducing the pressure of the hydraulic fluid at a relatively high pressure discharged from the main pump 14 by a predetermined pressure reducing valve, may be supplied to various hydraulic devices as the pilot pressure.

The operation device 26 is provided near the operator's seat of the cabin 10 and is used by the operator to operate various driven elements. Specifically, the operation device 26 is used for an operator to operate the hydraulic actuator HA that drives each driven element, and as a result, the operation by the operator of the driven element to be driven by the hydraulic actuator HA can be implemented. The operation device 26 includes a pedal device and a lever device for operating each driven element (hydraulic actuator HA).

For example, as illustrated in FIG. 6, the operation device 26 is of an electric type. Specifically, the operation device 26 outputs an electric signal (hereinafter, referred to as an "operation signal") corresponding to the operation content, and the operation signal is input to the controller 30. The controller 30 outputs an operation instruction corresponding to the content of the operation signal, that is, an operation instruction (control signal) corresponding to the operation content for the operation device 26 to the hydraulic control valve 31. Thus, the pilot pressure corresponding to the operation content of the operation device 26 is input from the hydraulic control valve 31 to the control valve 17, and the control valve 17 can drive each hydraulic actuator HA according to the operation content of the operation device 26.

Further, the directional control valves 17A to 17F that are incorporated in the control valve 17 and drive the respective hydraulic actuators HA may be electromagnetic solenoid type valves. In this case, the operation signal output from the operation device 26 may be directly input to the control valve 17 (that is, to the electromagnetic solenoid type directional control valves).

The operation device 26 may be a hydraulic pilot type. Specifically, the operation device 26 outputs a pilot pressure corresponding to the operation content to the pilot line on the secondary side by using the hydraulic fluid supplied from the pilot pump 15 through the pilot line. The pilot line on the secondary side is connected to the control valve 17. Thus, the pilot pressure corresponding to the operation content relating to various driven elements (hydraulic actuators HA) in the operation device 26 can be input to the control valve 17. Therefore, the control valve 17 can drive each hydraulic actuator HA according to the operation content of the operation device 26 by the operator or the like. In this case, an operation status sensor capable of acquiring information on the operation status of the operation device 26 is provided, and the output of the operation status sensor is input into the controller 30. Thus, the controller 30 can identify the operation status of the operation device 26. The operation status sensor is, for example, a pressure sensor that acquires information on a pilot pressure (operation pressure) of the pilot line on the secondary side of the operation device 26.

As described above, a part or all of the hydraulic actuators HA may be replaced with electric actuators. In this case, for example, the controller 30 may output an operation instruction corresponding to the operation content of the operation device 26 or the content of the remote operation defined by the remote operation signal to the electric actuator, or a driver or the like that drives the electric actuator. Further, the electric actuator may be configured to be operable by the operation device 26 by inputting an operation signal from the operation device 26 to the electric actuator, or the driver or the like.

The hydraulic control valve 31 is provided for each driven element (hydraulic actuator HA) to be operated by the operation device 26 and for each activation direction (for example, a raising direction and a lowering direction of the boom 4) of the driven element (hydraulic actuator HA). For example, two hydraulic control valves 31 are provided for each double-acting hydraulic actuator HA for driving the lower traveling body 1, the upper turning body 3, the boom 4, the arm 5, the bucket 6, and the like. Specifically, hydraulic control valves 31A to 31F corresponding to the boom 4, the arm 5, the bucket 6, the crawler 1CL, the crawler 1CR, and the upper turning body 3, respectively, may be provided (see FIG. 8). Each of the hydraulic control valves 31A to 31F is provided with two hydraulic control valves. The hydraulic control valve 31 may be provided, for example, in a pilot line between the pilot pump 15 and the control valve 17, and may be configured to be able to change the flow passage area (that is, the cross-sectional area through which the hydraulic fluid can flow). Thus, the hydraulic control valve 31 can output a predetermined pilot pressure to the pilot line on the secondary side by using the hydraulic fluid of the pilot pump 15 supplied through the pilot line on the primary side. Thus, the hydraulic control valve 31 can apply a predetermined pilot pressure corresponding to an operation instruction from the controller 30 to the control valve 17. Accordingly, for example, the controller 30 can cause the hydraulic control valve 31 to directly supply the pilot pressure corresponding to the operation content (operation signal) of the operation device 26 to the control valve 17, and can implement the activation of the shovel 100 based on the operation of the operator.

The controller 30 may control the hydraulic control valve 31 to implement a semi-automatic driving function of the shovel 100. Specifically, the controller 30 outputs an operation instruction corresponding to the semi-automatic driving function from the hydraulic control valve 31 to the hydraulic control valve 31. Thus, the controller 30 can implement the activation of the shovel 100 by the semi-automatic driving function.

The controller 30 may control the hydraulic control valve 31 to implement remote operation of the shovel 100. Specifically, the controller 30 uses the communication device 60 to output an operation instruction corresponding to a content of the remote operation designated by the remote operation signal received from the remote operation support device 200 to the hydraulic control valve 31. Thus, the controller 30 can cause the hydraulic control valve 31 to supply the pilot pressure corresponding to the content of the remote operation to the control valve 17, and can implement the activation of the shovel 100 based on the remote operation by the external operator.

In the case where the operation device 26 is of a hydraulic pilot type, a shuttle valve may be provided in a pilot line between the operation device 26 and the hydraulic control valve 31, and the control valve 17. The shuttle valve has two inlet ports and one outlet port, and outputs the hydraulic fluid having a higher pilot pressure of the pilot pressures input to the two inlet ports to the outlet port. The shuttle valve is provided for each driven element (hydraulic actuator HA) to be operated by the operation device 26 and for each activation direction of the driven element (hydraulic actuator HA), as in the hydraulic control valve 31. For example, two shuttle valves are provided for each double-acting hydraulic actuator HA for driving the lower traveling body 1, the upper turning body 3, the boom 4, the arm 5, the bucket 6, and the like. One of two inlet ports of the shuttle valve is connected to a pilot line on the secondary side of the operation device 26 (specifically, the above-described lever device or pedal device included in the operation device 26), and the other is connected to a pilot line on the secondary side of the hydraulic control valve 31. The outlet port of the shuttle valve is connected to the pilot port of the corresponding directional control valve of the control valve 17 through the pilot line. The corresponding directional control valve is a directional control valve that drives the hydraulic actuator HA to be operated of the above-described lever device or pedal device connected to one inlet port of the shuttle valve. Therefore, each of these shuttle valves can cause the higher one of a pilot pressure of the pilot line on the secondary side of the operation device 26 and a pilot pressure of the pilot line on the secondary side of the hydraulic control valve 31 to be applied to the pilot port of the corresponding directional control valve. That is, the controller 30 can control the corresponding directional control valve without relying on the operation of the operation device 26 by the operator by outputting the pilot pressure higher than the pilot pressure on the secondary side of the operation device 26 from the hydraulic control valve 31. Therefore, the controller 30 can control the activations of the driven elements (the lower traveling body 1, the upper turning body 3, the boom 4, the arm 5, and the bucket 6) without relying on an operation situation of the operator on the operation device 26, and can implement the semi-automatic driving function and the remote operation function.

In addition, in a case where the operation device 26 is a hydraulic pilot type, in addition to the shuttle valve, a pressure reducing valve may be provided in the pilot line between the operation device 26 and the shuttle valve. The pressure reducing valve is configured to be activated in response to a control signal input from the controller 30, for example, and to be capable of changing the flow passage area thereof. Thus, the controller 30 can forcibly reduce the pilot pressure output from the operation device 26 when the operation device 26 is operated by the operator. Therefore, even when the operation device 26 is operated, the controller 30 can forcibly control or stop the activation of the hydraulic actuator HA corresponding to the operation of the operation device 26. Further, for example, even when the operation device 26 is operated, the controller 30 can reduce the pilot pressure output from the operation device 26 by the pressure reducing valve to be lower than the pilot pressure output from the hydraulic control valve 31. Therefore, the controller 30 can reliably apply a desired pilot pressure to the pilot port of the directional control valve in the control valve 17, for example, independent of the operation content of the operation device 26 by controlling the hydraulic control valve 31 and the pressure reducing valve. Therefore, the controller 30 can more appropriately implement the semi-automatic driving function and the remote operation function of the shovel 100 by controlling the pressure reducing valve in addition to the hydraulic control valve 31, for example.

<<User Interface System>>

As illustrated in FIG. 6, a user interface system of the shovel 100 includes the operation device 26, an output device 50, and an input device 52.

The output device 50 outputs various kinds of information to a user of the shovel 100 (for example, an operator in the cabin 10 or an operator of an external remote operation), a person around the shovel 100 (for example, a worker or a driver of a work vehicle), or the like.

For example, the output device 50 includes an illumination device, a display device 50A, or the like that outputs various kinds of information in a visual manner. The illumination device is, for example, a warning lamp (indicator lamp) or the like. The display device 50A is, for example, a liquid-crystal display, an organic electroluminescence (EL) display, or the like. For example, as illustrated in FIGS. 2 and 3, the illumination device and the display device 50A may be provided inside the cabin 10, and output various kinds of information to an operator or the like inside the cabin 10 by a visual manner. The illumination device and the display device 50A may be provided on a side surface or the like of the upper turning body 3 and output various kinds of information to an operator or the like around the shovel 100 in a visual manner.

The outputting device 50 may include a sound output device 50B that outputs various kinds of information by an auditory method. The sound output device 50B includes, for example, a buzzer, a speaker, and the like. The sound output device 50B is provided, for example, at least one of inside and outside of the cabin 10, and outputs various kinds of information to the operator inside the cabin 10 and a person (worker or the like) around the shovel 100 by an auditory method.

The output device 50 may include a device that outputs various kinds of information by a tactile method such as vibration of an operator's seat.

The input device 52 receives various inputs from the user of the shovel 100, and signals corresponding to the received inputs are input into the controller 30. For example, as illustrated in FIGS. 2 and 3, the input device 52 is provided inside the cabin 10 and receives an input from an operator or the like inside the cabin 10. The input device 52 may be provided on, for example, a side surface of the upper turning body 3 and may receive an input from an operator or the like around the shovel 100.

For example, the input device 52 includes an operation input device that receives an input by a mechanical operation from the user. The operation input device may include a touch panel mounted on the display device, a touch pad installed around the display device, a button switch, a lever, a toggle, a knob switch provided in the operation device 26 (lever device), and the like.

The input device 52 may include an audio input device that receives voice input of the user. The audio input device includes, for example, a microphone.

The input device 52 may include a gesture input device that receives a gesture input of the user. The gesture input device includes, for example, an imaging device that images appearance of a gesture performed by the user.

The input device 52 may include a biometric input device that receives a biometric input of the user. The biometric input includes, for example, input of biometric information such as fingerprints and irises of the user.

<<Communication System>>

As illustrated in FIG. 6, the communication system of the shovel 100 according to the present embodiment includes a communication device 60.

The communication device 60 is connected to an external communication line NW and communicates with a device provided separately from the shovel 100. The device provided separately from the shovel 100 may include a portable terminal device (portable terminal) brought into the cabin 10 by the user of the shovel 100, in addition to the device outside the shovel 100. The communication device 60 may include a mobile communication module conforming to a standard such as 4G (4th Generation) or 5G (5th Generation). The communication device 60 may include, for example, a satellite communication module. The communication device 60 may include, for example, a WiFi communication module or a Bluetooth (registered trademark) communication module. In addition, when there are a plurality of connectable communication lines NW, the communication device 60 may include a plurality of communication devices 60 according to the types of the communication lines NW.

For example, the communication device 60 communicates with an external device such as the remote operation support device 200 in a work site through a local communication line constructed in the work site. The local communication line is, for example, a mobile communication line by a local 5G (so-called local 5G) constructed at the work site or a local network by a WiFi6.

The communication device 60 may communicate with an external device such as the remote operation support device 200 outside the work site through a wide area communication line including the work site, that is, a wide area network.

<<Control System>>

As illustrated in FIG. 6, the control system of the shovel 100 includes a controller 30. The control system of the shovel 100 according to the present embodiment includes the imaging device 40, an imaging device 45, and sensors S1 to S6.

The controller 30 performs various controls relating to the shovel 100.

The functions of the controller 30 may be implemented by any hardware, or any combination of hardware and software, or the like. For example, as illustrated in FIG. 6, the controller 30 includes an auxiliary storage device 30A, a memory device 30B, a central processing unit (CPU) 30C, and an interface device 30D, which are connected to each other via a bus B1.

The auxiliary storage device 30A is a non-volatile storage part, and stores a program to be installed. The auxiliary storage device 30A is, for example, an electrically erasable programmable read-only memory (EEPROM), a flash memory, or the like.

The memory device 30B loads the program in the auxiliary storage device 30A so that the CPU 30C can read the program, for example, when an instruction to start the program is executed. The memory device 30B is, for example, a static random access memory (SRAM).

The CPU 30C is processing circuitry that executes, for example, a program loaded into the memory device 30B, and implements various functions of the controller 30 according to instructions of the program.

The interface device 30D functions as, for example, a communication interface for connection to a communication line inside the shovel 100. The interface device 30D may include a plurality of different types of communication interfaces according to the types of communication lines to be connected.

The interface device 30D functions as an external interface for reading and writing of information from and to a recording medium. The RECORDING MEDIUM is, for example, a dedicated tool that is connected to a connector installed inside the cabin 10 by a detachable cable. The recording medium may be a general-purpose recording medium such as an SD memory card or a universal serial bus (USB) memory. Thus, the program for implementing various functions of the controller 30 can be provided by, for example, a portable recording medium and installed in the auxiliary storage device 30A of the controller 30. The program may be downloaded from another computer outside the shovel 100 through the communication device 60 and installed in the auxiliary storage device 30A.

Note that some of the functions of the controller 30 may be implemented by another controller (control device). That is, the function of the controller 30 may be implemented by a plurality of controllers mounted on the shovel 100 in a distributed manner.

The imaging device 40 acquires an image representing a surrounding situation of the shovel 100. The imaging device 40 may acquire (generate) three-dimensional data (hereinafter, simply referred to as "three-dimensional data of an object") indicating the position and the outer shape of an object around the shovel 100 in the imaging range (angle of view), based on the acquired image and data relating to a distance described later. The three-dimensional data of an object around the shovel 100 is, for example, data of coordinate information of a point group representing the surface of the object, distance image data, or the like.

For example, as illustrated in FIGS. 2 and 3, the imaging device 40 includes a front camera 40F that images the front of the upper turning body 3. The imaging device 40 may include a rear camera 40B that images the rear of the upper turning body 3, a left camera 40L that images the left of the upper turning body 3, a right camera 40R that images the right of the upper turning body 3, and the like. Thus, the imaging device 40 can image the entire circumference around the shovel 100 in a top view of the shovel 100, that is, a range over an angular direction of 360 degrees. The operator can visually recognize the surrounding image based on the captured images of the left camera 40L, the right camera 40R, and the rear camera 40B through the display device 50A or the display device 208 of the remote operation support device 200, and can check the situations of the left side, the right side, and the rear side of the upper turning body 3. Further, the operator can remotely operate the shovel 100 while checking the operation of the attachment AT including the bucket 6 by visually recognizing the surrounding image based on the front camera 40F through the display device 208 of the remote operation support device 200.

The imaging device 40 is, for example, a monocular camera. The imaging device 40 may be capable of acquiring data relating to a distance (depth), in addition to a two dimensional image, as in a stereo camera, a time of flight (TOF) camera a camera, or the like (hereinafter collectively referred to as a "3D camera").

Output data (for example, image data, three dimensional data of the object around the shovel 100, or the like) of the imaging device 40 are input into the controller 30 through a one-to-one communication line or an in-vehicle network. Thus, the controller 30 can monitor an object around the shovel 100, based on the output data of the imaging device 40, for example. Further, the controller 30 can determine the surrounding environment of the shovel 100, based on the output data of the imaging device 40, for example. In addition, the controller 30 can determine a posture status of the attachment AT illustrated in the captured image, based on the output data of the imaging device 40 (front camera), for example. Further, for example, the controller 30 can determine a posture status of a body (upper turning body 3) of the shovel 100 with reference to the object around the shovel 100 based on the output data of the imaging device 40.

Depending on the application of the imaging device 40, some of the front camera 40F, the rear camera 40B, the left camera 40L, and the right camera 40R may be omitted. Further, in a case where an external operator can perform remote control while directly visually recognizing the shovel 100 or the ground surface to be worked on in the vicinity of the shovel 100, the imaging device 40 may be omitted.

Further, instead of or in addition to the imaging device 40, a range sensor may be provided in the upper turning body 3. The range sensor is attached to, for example, an upper portion of the upper turning body 3, and acquires data relating to the distance and direction of an object around the shovel the shovel 100. The range sensor may acquire (generate) three dimensional data (for example, data of coordinate information of a point group) of the object around the shovel 100 in the sensing range, based on the acquired data. The range sensor is, for example, a Light Detection and Ranging (LIDAR). Further, for example, the range sensor may be a millimeter wave radar, an ultrasonic sensor, an infrared sensor, or the like.

The imaging device 45 is provided inside the cabin 10, and captures images of a situation inside the cabin 10. For example, as illustrated in FIG. 3, the imaging device 45 is disposed with the lens facing the operator's seat so that the imaging range includes the operator OP1 in the operator's seat. The output of the imaging device 45 is input into the controller 30.

Instead of or in addition to the imaging device 45, a range sensor may be provided inside the cabin 10. In this case, the range sensor may be disposed so that the sensing range includes the operator OP1 in the operator's seat.

The sensor S1 is attached to the boom 4, and measures a posture status of the boom 4. The sensor S1 outputs measurement data representing the posture status of the boom 4. The posture status of the boom 4 is, for example, a posture angle (hereinafter, referred to as a "boom angle") around a rotation axis of a base end corresponding to a connection portion of the boom 4 with the upper turning body 3. The sensor S1 includes, for example, a rotary potentiometer, a rotary encoder, an acceleration sensor, an angular accelerometer, a six axis sensor, an inertial measurement unit (IMU), and the like. Hereinafter, the same may apply to the sensors S2 to S4. The sensor S1 may include a cylinder sensor that detects an extended or contracted position of the boom cylinder 7. The same may apply to the sensors S2 and S3. Outputs of the sensor S1 (measurement data representing the posture status of the boom 4) are input into the controller 30. Thus, the controller 30 can identify the posture status of the boom 4.

The sensor S2 is attached to the arm 5, and measures a posture status of the arm 5. The sensor S2 outputs measurement data representing the posture status of the arm 5. The posture status of the arm 5 is, for example, a posture angle (hereinafter, referred to as an "arm angle") around a rotation axis of a base end corresponding to a connection portion of the arm 5 with the boom 4. Outputs of the sensor S2 (measurement data representing the posture status of the arm 5) are input into the controller 30. Thus, the controller 30 can identify the posture status of the arm 5.

The sensor S3 is attached to the bucket 6, and measures a posture status of the bucket 6. The sensor S3 outputs measurement data representing the posture status of the bucket 6. The posture status of the bucket 6 is, for example, a posture angle (hereinafter, referred to as a bucket angle) around a rotation axis of a base end corresponding to a connection portion of the bucket 6 with the arm 5. Outputs of the sensor S3 (measurement data representing the posture status of the bucket 6) are input into the controller 30. Thus, the controller 30 can identify the posture status of the bucket 6.

The sensor S4 measures a posture status of a body (for example, the upper turning body 3) of the shovel 100. The sensor S4 outputs measurement data representing the posture status of the body of the shovel 100. The posture status of the body of the shovel 100 is, for example, an inclination status of the body with respect to a predetermined reference plane (for example, a horizontal plane). For example, the sensor S4 is attached to the upper turning body 3, and measures inclination angles (hereinafter, referred to as a "front-rear inclination angle" and a "left-right inclination angle") around two axes in the front-rear direction and the left-right direction of the shovel 100. Outputs of the sensor S4 (measurement values indicating the posture status of the body of the shovel 100) are input into the controller 30. Thus, the controller 30 can identify the posture status (inclined status) of the body (upper turning body 3) of the shovel 100.

The sensor S5 is attached to the upper turning body 3, and measures a turning status of the upper turning body 3. The sensor S5 outputs measurement data representing the turning status of the upper turning body 3. The sensor S5 measures, for example, a turning angular velocity and a turning angle of the upper turning body 3. The sensor S5 includes, for example, a gyro sensor, a resolver, a rotary encoder, and the like. Outputs of the sensor S5 (measurement values indicating the turning status of the upper turning body 3) are input into the controller 30. Thus, the controller 30 can identify the turning status such as the turning angle of the upper turning body 3.

For example, the controller 30 can identify (estimate) the position of the tip end of the attachment AT (bucket 6) based on the outputs of the sensors S1 to S5. Therefore, the controller 30 can control the operation of the shovel 100 by the automatic operation function while identifying the position of the tip end of the attachment AT.

Note that, in a case where the sensor S4 includes a gyro sensor, a six axis sensor, an IMU, or the like capable of detecting angular velocities about three axes, the turning status (for example, turning angular velocity) of the upper turning body 3 may be detected based on detection signals of the sensor S4. In this case, the sensor S5 may be omitted.

The sensor S6 measures the position of the shovel 100. The sensor S6 may measure the position in world (global) coordinates or may measure the position in local coordinates at the work site. In the former case, the sensor S6 is, for example, a global navigation satellite system (GNSS) sensor. In the latter case, the sensor S6 is a transmitter-receiver capable of communicating with a device serving as a reference of the position of the work site and outputting a signal corresponding to the position with respect to the reference. The output of the sensor S6 is input into the controller 30.

Note that, when the semi-automatic driving function is not mounted on the shovel 100, the sensors S1 to S6 may be omitted.

<Hardware Configuration of Remote Operation Support Device>

Figure 7:
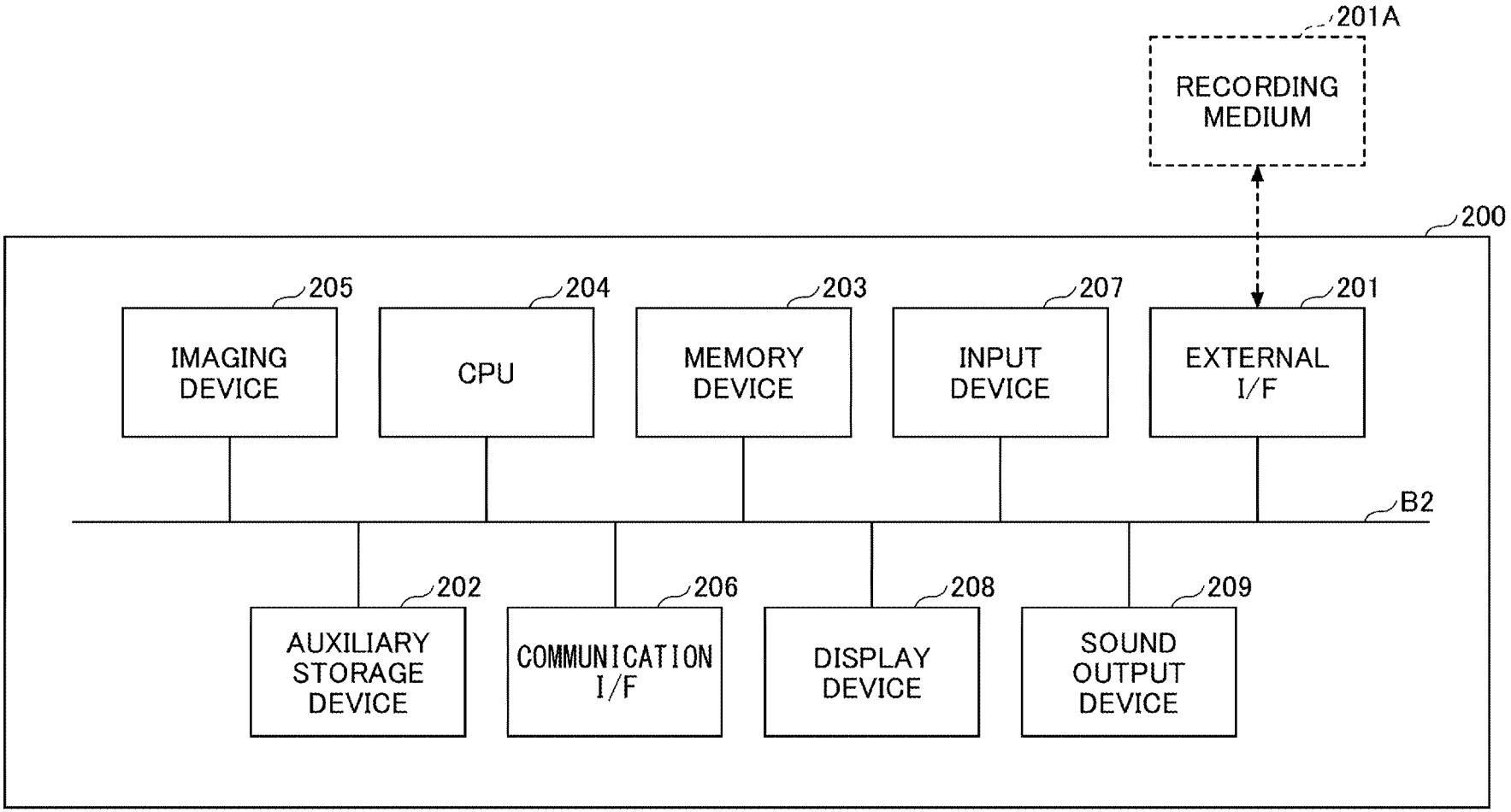
FIG. 7 is a diagram illustrating an example of a hardware configuration of a remote operation support device.

FIG. 7 is a block diagram illustrating an example of a hardware configuration of the remote operation support device 200.

The functions of the remote operation support device 200 are implemented by any hardware, any combination of hardware and software, or the like. For example, as illustrated in FIG. 7, the remote operation support device 200 includes an external interface 201, an auxiliary storage device 202, a memory device 203, a CPU 204, an imaging device 205, a communication interface 206, an input device 207, the display device 208, and a sound output device 209. These components are connected by a bus B2.

The external interface 201 functions as an interface for reading data from a recording medium 201A and writing data to the recording medium 201A. The recording medium 201A include, for example, flexible disks, CDs (Compact Discs), DVDs (Digital Versatile Discs), BD (Blu-ray (trademark) Disc), SD memory cards, USB-type memories, and the like. The remote operation support device 200 can read various kinds of information used in processing and store the information in the auxiliary storage device 202, and can install programs for implementing various functions, through the recording medium 201A.

The remote operation support device 200 may acquire various data and programs used in processing from an external device via the communication interface 206.

The auxiliary storage device 202 stores the installed various programs, and also stores files, data, and the like necessary for various processes. The auxiliary storage device 202 includes, for example, a hard disc drive (HDD), a solid state disc (SSD), a flash memory, or the like.

When an instruction to start a program is issued, the memory device 203 reads the program from the auxiliary storage device 202 and stores the program. The memory device 203 includes, for example, a dynamic random access memory (DRAM) or an SRAM.

The CPU 204 is processing circuitry that executes various programs loaded from the auxiliary storage device 202 to the memory device 203, and implements various functions relating to the remote operation support device 200 according to the programs.

The imaging device 205 images a situation of an operator who performs remote control outside the shovel 100.

For example, as illustrated in FIG. 5, the imaging device 205 is disposed in the remote control room RCR, and is disposed with the lens facing the operator's seat so that the operator OP2 in the operator's seat is included in the imaging range. In addition, when the remote operation support device 200 is a mobile terminal, the imaging device 205 is incorporated in a housing of the remote operation support device 200 (mobile terminal) and is disposed so that a lens is exposed to the outside of the housing in the vicinity of the display device 208.

Note that a range sensor may be provided instead of or in addition to the imaging device 205.

The communication interface 206 is used as an interface for connecting to an external device so as to be able to communicate with the external device. Thus, the remote operation support device 200 can communicate with an external device such as the shovel 100 through the communication interface 206. The communication interface 206 may include a plurality of types of communication interfaces according to the communication method between the communication interface and a device to be connected.

The input device 207 receives various inputs from a user. For example, the input device 207 includes an operation device 207A for remote operation so as to perform remote operation of the shovel 100.

The input device 207 includes, for example, an input device (hereinafter, referred to as an "operation input device") in a form of receiving a mechanical operation input from a user. The operation device for remote operation may be an operation input device. The operation input device includes, for example, a button, a toggle, a lever, a keyboard, a mouse, a touch panel mounted on the display device 208, a touch pad provided separately from the display device 208, and the like.

The input device 207 may include an audio input device capable of receiving voice input from a user. The audio input device includes, for example, a microphone capable of collecting the voice of the user.

The input device 207 may include a gesture input device capable of receiving a gesture input from the user. The gesture input device includes, for example, a camera capable of capturing an image of a gesture of the user.

The input device 207 may include a biometric input device capable of receiving a biometric input from the user. The biometric input device includes, for example, a camera capable of acquiring image data containing information on a fingerprint or an iris of the user.

The display device 208 displays an information screen and an operation screen to a user of the remote operation support device 200. The display device 208 is, for example, a liquid crystal display or an organic electroluminescence (EL) display. For example, the display device 208 includes display devices 208A to 208C installed in the remote control room RCR.

The sound output device 209 transmits various kinds of information to the user of the remote operation support device 200 by sound. The sound output device 209 is, for example, a buzzer, an alarm, a speaker, or the like.

[Functional Configuration for Operation of Shovel]

Next, a functional configuration relating to the operation of the shovel 100 in the remote operation support system SYS will be described with reference to FIG. 8 in addition to FIGS. 1 to 7.

Figure 8:
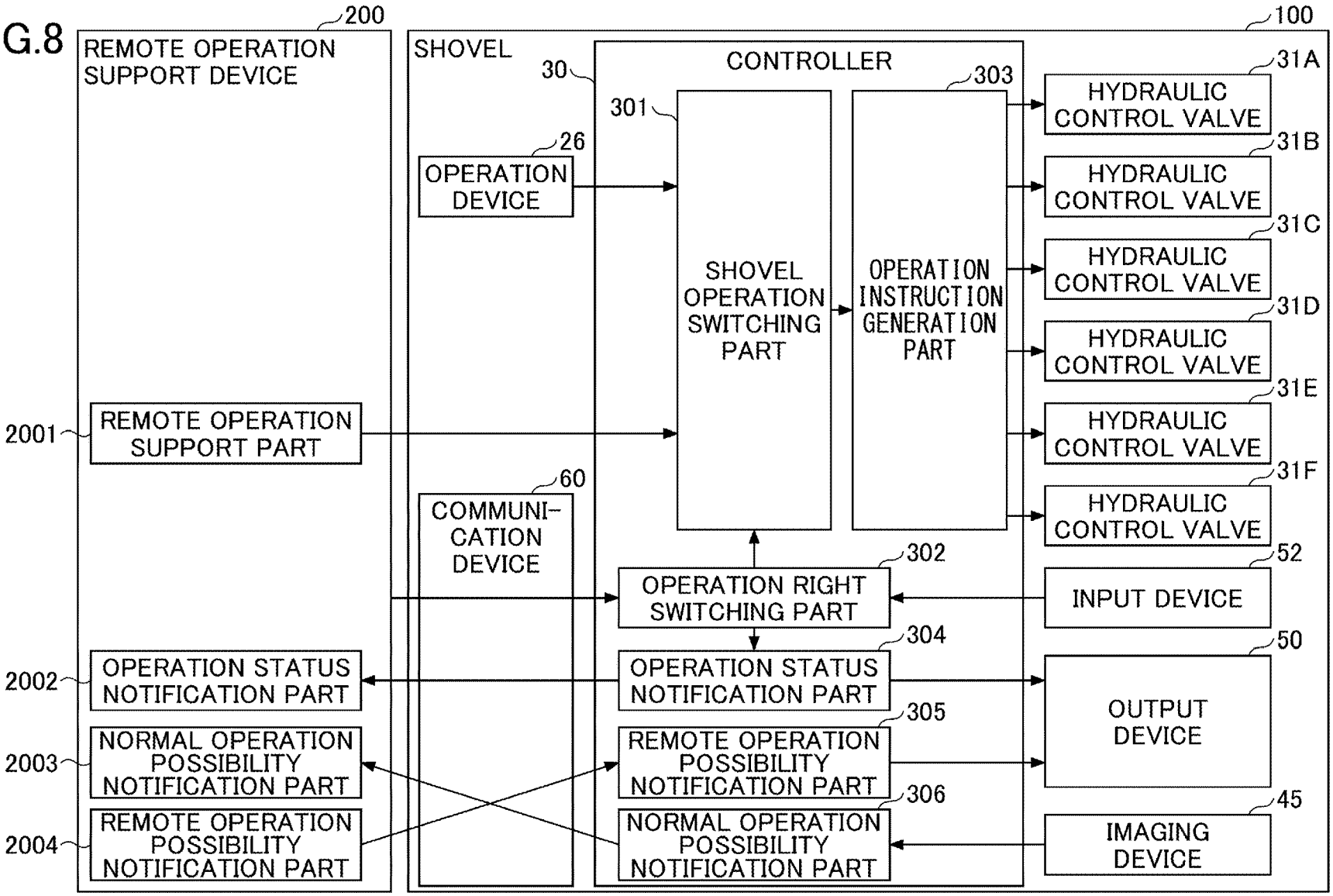
FIG. 8 is a diagram illustrating an example of a functional configuration relating to an operation of the shovel in the remote operation support system.

FIG. 8 is a functional block diagram illustrating an example of a functional configuration relating to the operation of the shovel 100 in the remote operation support system SYS.

<Functional Configuration of Shovel>

As illustrated in FIG. 8, the controller 30 of the shovel 100 includes, as functional parts, a shovel operation switching part 301, an operation right switching part 302, an operation instruction generation part 303, an operation status notification part 304, a remote operation possibility notification part 305, and a normal operation possibility notification part 306.

The shovel operation switching part 301 selectively switches between a status in which an operator in the cabin 10 performs an operation (hereinafter, referred to as a "normal operation") of the shovel 100 and a status in which an operator outside the shovel 100 performs a remote operation of the shovel 100. Specifically, the shovel operation switching part 301 switches between the normal operation status and the remote operation status according to whether the operator in the cabin 10 or the operator outside the shovel 100 has the authorization to operate the shovel 100 (hereinafter, "operation right").

When the operator in the cabin 10 has the operation right, the shovel operation switching part 301 permits the operation (normal operation) of the shovel 100 by the input to the operation device 26 and prohibits the operation (remote operation) of the shovel 100 by the operator outside the shovel 100. Specifically, when the operator in the cabin 10 has the operation right, the shovel operation switching part 301 outputs an operation signal corresponding to the input to the operation device 26 to the operation instruction generation part 303, and does not output a remote operation signal to the operation instruction generation part 303 even when the remote operation signal is input. On the other hand, when the operator outside the shovel 100 has the operation right, the shovel operation switching part 301 outputs a remote operation signal corresponding to the input of the remote operation to the operation instruction generation part 303, and does not output an operation signal to the operation instruction generation part 303 even when the operation signal is input from the operation device 26. Thus, even when the input to the operation device 26 and the input of the remote operation are simultaneously performed, the shovel operation switching part 301 can activate the shovel 100 in response to either one of the inputs according to the rule defined in advance.

The operation right switching part 302 selectively switches between a status in which the operator in the cabin 10 has the operation right and a status in which the operator outside the shovel 100 has the operation right.

For example, the operation right switching part 302 sets the operation right of the shovel 100 to a predetermined initial status at the time of activation of the shovel 100. The predetermined initial status is, for example, a status in which an operation right is given to one of the operator in the cabin 10 and the operator outside the shovel 100 who has a priority registered in advance. The priority may be fixed or may be changeable by the manager or the like of the shovel 100. The predetermined initial status may be a status in which the operation right is given to one operator who has activated the shovel 100, of the operator in the shovel 100 and the operator outside the shovel 100. For example, the operator in the cabin 10 can activate the shovel 100 by turning on a key switch inside the cabin 10. Further, for example, the operator outside the shovel 100 can activate the shovel 100 by performing a predetermined input using the input device 207 and causing the remote operation support device 200 to transmit an activation instruction to the shovel 100.

The operation right switching part 302 may switch the operation right to one operator in response to an input of a request from the other operator having the operation right among the operator in the cabin 10 and the operator outside the shovel 100. In this case, in response to an input of a request from the operator having the operation right, the operator may switch to the other operator after confirming permission of switching of the operation right to the other operator. In this case, the operation right switching part 302 may request the other operator to confirm permission of switching of the operation right through the display device 50A in the cabin 10 or the display device 208 of the remote operation support device 200. The operation right switching part 302 may switch the operator's operation right in response to an input of confirmation of permission from another operator, which is received by the input device 52 inside the cabin 10 or by the input device 207 of the remote operation support device 200.

Further, the operation right switching part 302 may switch the operation right of the shovel 100 to one operator in response to an input of a request from this one operator who does not have the operation right and has priority among the operator in the cabin 10 and the operator outside the shovel 100.

The operation instruction generation part 303 outputs an operation instruction to the hydraulic control valves 31A to 31F in response to a signal output from the shovel operation switching part 301, that is, an operation signal corresponding to an input to the operation device 26 or a remote operation signal corresponding to an input of a remote operation. Thus, the shovel 100 can activate the driven element (hydraulic actuator HA) in response to the input to the operation device 26 or the input of the remote operation.

Specifically, the operation instruction generation part 303 generates and outputs an operation instruction for the hydraulic control valve 31A corresponding to the boom cylinder 7 according to the content of the operation relating to the boom 4 (boom cylinder 7) designated by the operation signal or the remote operation signal.

The operation instruction generation part 303 generates and outputs an operation instruction for the hydraulic control valve 31B corresponding to the arm cylinder 8 according to the content of the operation relating to the arm 5 (arm cylinder 8) designated by the operation signal or the remote operation signal.

The operation instruction generation part 303 generates and outputs an operation instruction for the hydraulic control valve 31C corresponding to the bucket cylinder 9 according to the content of the operation relating to the bucket 6 (bucket cylinder 9) designated by the operation signal or the remote operation signal.

The operation instruction generation part 303 generates and outputs an operation instruction for the hydraulic control valve 31D corresponding to the traveling hydraulic motor 1ML according to the content of the operation relating to the crawler 1CL (traveling hydraulic motor 1ML) designated by the operation signal or the remote operation signal.

The operation instruction generation part 303 generates and outputs an operation instruction for the hydraulic control valve 31E corresponding to the traveling hydraulic motor 1MR according to the content of the operation relating to the crawler 1CR (traveling hydraulic motor 1MR) designated by the operation signal or the remote operation signal.

The operation instruction generation part 303 generates and outputs an operation instruction for the hydraulic control valve 31F corresponding to the turning hydraulic motor 2M according to the content of the operation relating to the upper turning body 3 (turning hydraulic motor 2M) designated by the operation signal or the remote operation signal.

The operation status notification part 304 notifies the operator of the shovel 100 of the operation status of the shovel 100. Specifically, the operation status notification part 304 notifies the operator of the shovel 100 whether the shovel 100 is being normally operated or remotely operated.

For example, the operation status notification part 304 notifies the operator in the cabin 10 of whether or not the remote operation of the shovel 100 by the operator outside the shovel 100 is performed through the output device 50. Thus, the operator in the cabin 10 can recognize whether or not the remote operation of the shovel 100 is currently performed.

For example, the operation status notification part 304 notifies an operator outside the shovel 100 of whether or not the normal operation of the shovel 100 is being performed by the operator in the cabin 10 through the remote operation support device 200. Specifically, the operation status notification part 304 transmits a notification signal indicating whether or not the normal operation of the shovel 100 is being performed by the operator in the cabin 10 to the remote operation support device 200 through the communication device 60. Thus, the operator outside the shovel 100 using the remote operation support device 200 can recognize whether or not the normal operation of the shovel 100 is currently performed.

The remote operation possibility notification part 305 notifies the operator in the cabin 10 of the presence or absence of the possibility of the remote operation of the shovel 100 being performed, through the output device 50. Thus, the operator in the cabin 10 can recognize whether or not there is a possibility of the remote operation of the shovel 100 being performed.

For example, the remote operation possibility notification part 305 notifies the operator in the cabin 10 of the presence or absence of the possibility of the remote operation of the shovel 100 being performed, based on the notification signal indicating the presence or absence of the possibility of the remote operation of the shovel 100 being performed, which is received from the remote operation support device 200.

The remote operation possibility notification part 305 may determine the presence or absence of the possibility of the remote operation of the shovel 100 being performed, based on a real-time captured image by the imaging device 205 received from the remote operation support device 200 and notify the operator in the cabin 10 of the determination result.

The remote operation possibility notification part 305 may display, on the display device 50A, a real-time captured image by the imaging device 205, which is received from the remote operation support device 200. This is because the operator in the cabin 10 can determine whether or not there is a possibility of the remote operation of the shovel 100 being performed, from the presence or absence of the operator, the situation of the operator, or the like in the real-time captured image by the imaging device 205.

The controller 30 may include only one of the operation status notification part 304 and the remote operation possibility notification part 305.

The normal operation possibility notification part 306 notifies an operator outside the shovel 100 of the presence or absence of the possibility of the normal operation of the shovel 100 being performed. Specifically, the normal operation possibility notification part 306 transmits a notification signal relating to the presence or absence of the possibility of the normal operation of the shovel 100 being performed to the remote operation support device 200 through the communication device 60. Thus, the operator outside the shovel 100 can recognize whether or not there is a possibility of the normal operation of the shovel 100 being performed, through the display device 208, the sound output device 209, or the like of the remote operation support device 200.

For example, the normal operation possibility notification part 306 determines the presence or absence of the possibility of the normal operation of the shovel 100 being performed, by recognizing the presence or absence of the operator inside the cabin 10, the situation of the operator, and the like, based on the captured image by the imaging device 45. Then, the normal operation possibility notification part 306 transmits a notification signal including the determination result to the remote operation support device 200 through the communication device 60.

The normal operation possibility notification part 306 may transmit a notification signal including a real-time captured image by the imaging device 45 to the remote operation support device 200 through the communication device 60. For example, the remote operation support device 200 can determine the presence or absence of the possibility of the normal operation of the shovel 100 being performed, by recognizing the presence or absence of the operator inside the cabin 10, the situation of the operator, and the like, based on the real-time captured image by the imaging device 45. Further, for example, the operator outside the shovel 100 of the imaging device 45 can determine the situation of the operator of the shovel 100 from the presence or absence of the operator, the situation of the operator, and the like in the real-time captured image by the imaging device 45.

As will be described later, when the remote operation support device 200 includes only the operation status notification part 2002 among the operation status notification part 2002 and the normal operation possibility notification part 2003, the normal operation possibility notification part 306 is omitted.

As described above, when the shovel 100 is being remotely operated or when there is a possibility that the shovel 100 can be remotely operated, the controller 30 can notify the operator in the cabin 10 of either case through the output device 50. Thus, the operator in the cabin 10 can appropriately recognize the operation status of the shovel 100 by the operator outside the shovel 100. Therefore, the controller 30 can prevent a situation where the shovel 100 is activated along with the remote control of the shovel 100 performed by the operator outside the shovel 100 at a timing that is unexpected by the operator in the cabin 10.

<Functional Configuration of Remote Operation Support Device>

As illustrated in FIG. 8, the remote operation support device 200 includes, as functional parts, a remote operation support part 2001, an operation status notification part 2002, a normal operation possibility notification part 2003, and a remote operation possibility notification part 2004.

The remote operation support part 2001 transmits a remote operation signal from the communication interface 206 to the shovel 100 in response to an input to the operation device 207A.

Note that, in a case where an input of a remote operation is performed without using the remote operation support device 200, such as a gesture being input directly to the shovel 100, the remote operation support part 2001 is omitted.

The operation status notification part 2002 notifies an operator outside the shovel 100 who uses the remote operation support device 200 of whether or not the normal operation of the shovel 100 is being performed by the operator in the cabin 10, through the display device 208 or the sound output device 209. Specifically, the operation status notification part 2002 can notify the operator outside the shovel 100 of whether or not the normal operation of the shovel 100 is being performed by the operator in the cabin 10, based on the notification signal received from the shovel 100 (operation status notification part 304) through the communication interface 206.

The normal operation possibility notification part 2003 notifies the operator outside the shovel 100 who uses the remote operation support device 200 of whether or not there is a possibility of the normal operation of the shovel 100 being performed, through the display device 208 or the sound output device 209. Thus, the operator outside the shovel 100 can recognize whether or not there is a possibility of the normal operation of the shovel 100 being performed, through the remote operation support device 200. Specifically, the normal operation possibility notifying section 2003 can notify the operator outside the shovel 100 of whether or not there is a possibility of the normal operation of the shovel 100 being performed, based on the notification signal received from the shovel 100 (normal operation possibility notification part 306) through the communication interface 206.

For example, the normal operation possibility notification part 2003 notifies the operator outside the shovel 100 of whether or not there is a possibility of the normal operation of the shovel 100 being performed, based on the determination result described above included in the notification signal received from the shovel 100 through the communication interface 206.

The normal operation possibility notification part 2003 may determine the presence or absence of the possibility of the normal operation of the shovel 100 being performed, based on the real-time captured image by the imaging device 45 included in the notification signal received from the shovel 100 through the communication interface 206.

The normal operation possibility notification part 2003 may cause the display device 208 to display the real-time captured image by the imaging device 45 included in the notification signal received from the shovel 100 through the communication interface 206. This is because the operator outside the shovel 100 can determine whether or not there is a possibility of the normal operation of the shovel 100 being performed, from the presence or absence of the operator, the situation of the operator, and the like in the real-time captured image by the imaging device 45.

The remote operation support device 200 may include only one of the operation status notification part 2002 and the normal operation possibility notification part 2003.

The remote operation possibility notification part 2004 notifies the operator in the cabin 10 of the presence or absence of the possibility of the remote operation of the shovel 100 being performed. Specifically, the remote operation possibility notification part 2004 transmits a notification signal relating to the presence or absence of the possibility of the remote operation of the shovel 100 being performed to the shovel 100 through the communication interface 206. Thus, the operator in the cabin 10 can recognize whether or not there is a possibility of the remote operation of the shovel 100 being performed, through the output device 50 of the shovel 100.

For example, the remote operation possibility notification part 2004 determines whether or not there is a possibility of the remote operation of the shovel 100 being performed, by recognizing the presence or absence of the operator, the situation of the operator, or the like in the captured image, based on the captured image by the imaging device 205. Then, the remote operation possibility notification part 2004 transmits a notification signal including the determination result to the shovel 100 through the communication interface 206.

The remote operation possibility notification part 2004 may transmit a notification signal including the real-time captured image by the imaging device 205 to the shovel 100 through the communication interface 206.

As described above, when the controller 30 includes only the operation status notification part 304 of the operation status notification part 304 and the remote operation possibility notification part 305, the remote operation possibility notification part 2004 is omitted.

In this way, when the shovel 100 is being normally operated or when there is a possibility that the shovel 100 can be normally operated, the remote operation support device 200 can notify the operator outside the shovel 100 of either case through the output device 50. Thus, the operator outside the shovel 100 can appropriately recognize the operation status of the shovel 100 by the operator in the cabin 10. Therefore, the remote operation support device 200 can prevent a situation where the shovel 100 is activated along with the normal operation of the shovel 100 performed by the operator in the cabin 10 at a timing that is unexpected by the operator outside the shovel 100.

[Notification Process Relating to Implementation Status of Remote Operation of Shovel]

Next, a notification process relating to an implementation status of remote operation of the shovel 100, which is executed by the controller 30, will be described with reference to FIGS. 9 and 10.

First Example

Figure 9:
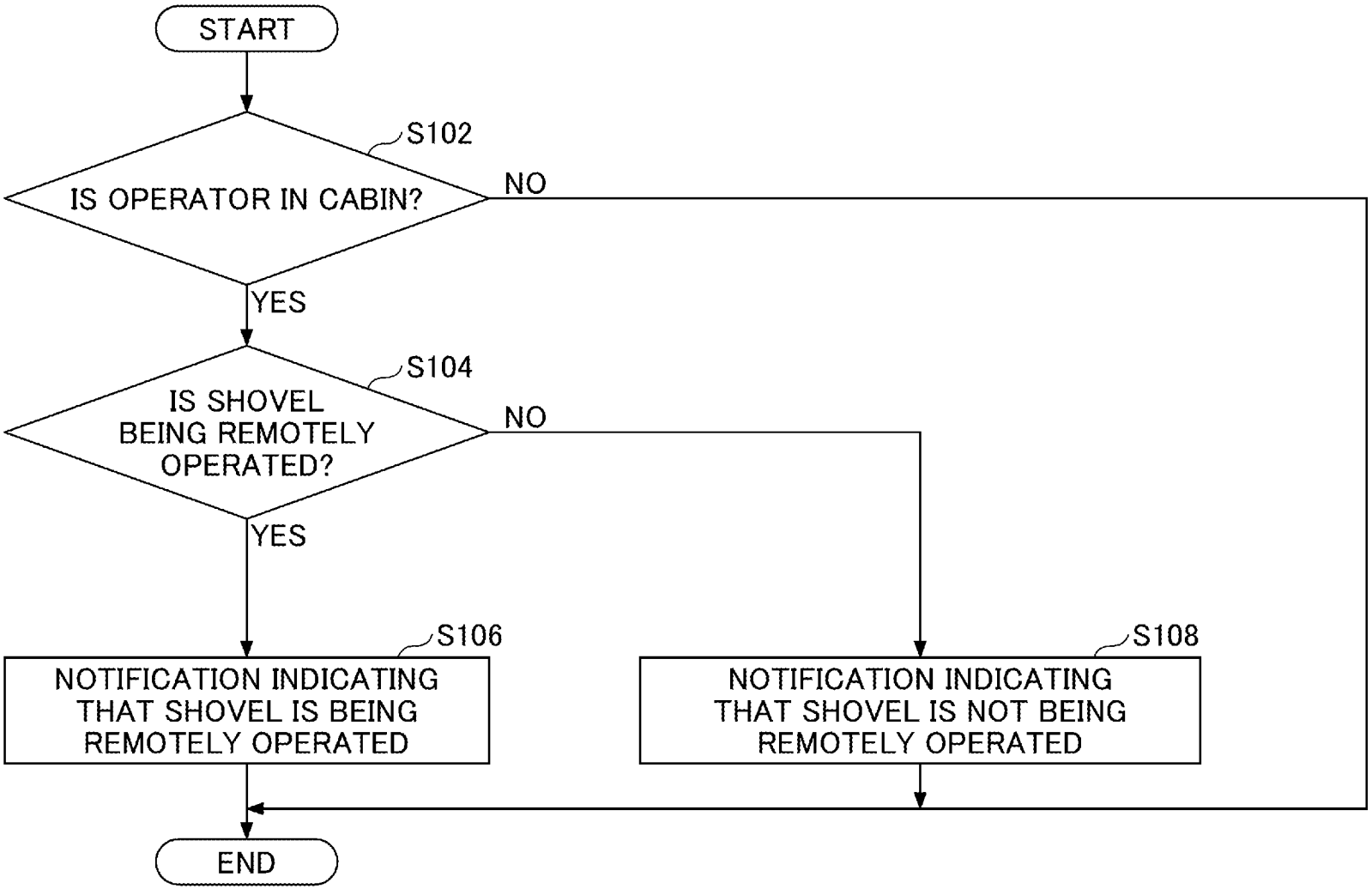
FIG. 9 is a flowchart schematically illustrating a first example of a notification process relating to an implementation status of a remote operation of the shovel.

FIG. 9 is a flowchart schematically illustrating a first example of a notification process relating to an implementation status of the remote operation of the shovel 100.

In the present example, a description will be given on the assumption that the controller 30 includes only the operation status notification part 304 among the operation status notification part 304 and the remote operation possibility notification part 305.

This flowchart is repeatedly executed at predetermined processing intervals during the operation of the shovel 100 from the start to the stop, for example. The same applies to the flowchart of FIG. 10.

As illustrated in FIG. 9, in step S102, the controller 30 determines whether or not an operator is in the cabin 10.

The controller 30 may determine whether or not the operator is in the cabin 10 by any method. For example, the controller 30 determines whether or not the operator is in the cabin 10 based on the captured image by the imaging device 45. The controller 30 may determine whether or not the operator is in the cabin 10 by whether a gate bar near the operator's seat allows the operator to pass between the operator's seat and the entrance of the cabin 10.

The controller 30 proceeds to step S104 when the operator is in the cabin 10; otherwise, the current flowchart ends.

The process of step S102 may be omitted. The same may apply to step S202 described later.

In step S104, the operation status notification part 304 determines whether or not the shovel 100 is being remotely operated. The operation status notification part 304 proceeds to step S106 when the shovel 100 is being remotely operated, otherwise it proceeds to step S108.

In step S106, the operation status notification part 304 outputs a notification indicating that the shovel 100 is being remotely operated, through the output device 50 in the cabin 10.

On the other hand, in step S108, the operation status notification part 304 outputs a notification indicating that the shovel 100 is not being remotely operated, through the output device 50 in the cabin 10.

When the process of step S106 or step S108 is completed, the process of the current flowchart is ended.

Note that the process of step S108 may be omitted.

As described above, in the present example, when the remote operation of the shovel 100 is being performed, the controller 30 can notify the operator in the cabin 10 that the remote operation of the shovel 100 is being performed.

Second Example

Figure 10:
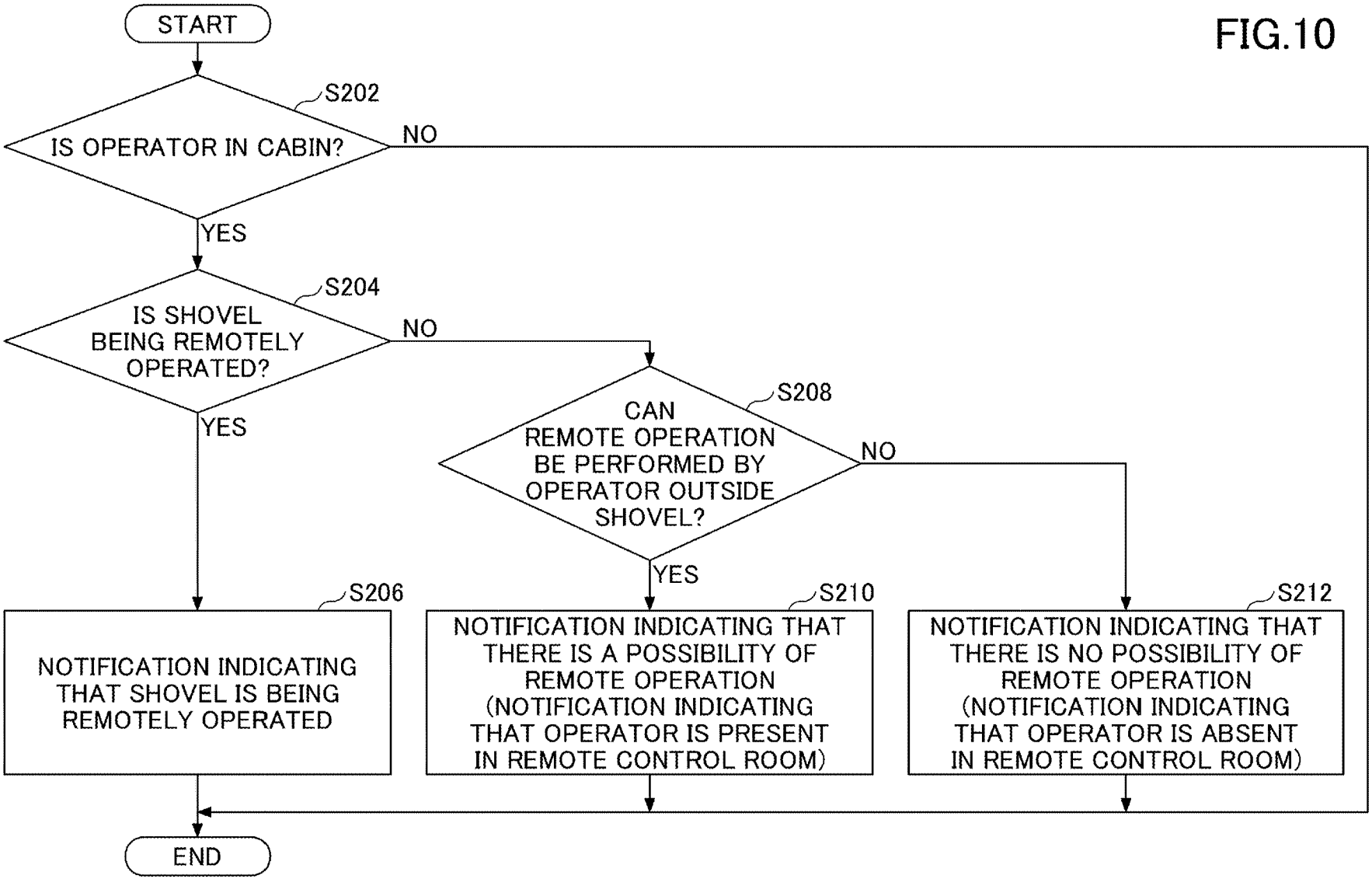
FIG. 10 is a flowchart schematically illustrating a second example of a notification process relating to an implementation status of the remote operation of the shovel.

FIG. 10 is a flowchart schematically illustrating a second example of a notification process relating to an implementation status of remote operation of the shovel 100.

In the present example, a description will be given on the assumption that the controller 30 includes both the operation status notification part 304 and the remote operation possibility notification part 305.

As illustrated in FIG. 10, the processes in steps S202 and S204 are the same as the processes in steps S102 and S104 in FIG. 9, and thus, a description thereof is omitted.

In step S204, the operation status notification part 304 proceeds to step S206 when the shovel 100 is being remotely operated, otherwise it proceeds to step S208.

The process of step S206 is the same as the process of step S106 in FIG. 9, and thus a description thereof will be omitted.

On the other hand, in step S208, the remote operation possibility notification part 305 determines whether or not the shovel 100 can be remotely operated by the operator outside the shovel 100, based on the notification signal from the remote operation support device 200 (the remote operation possibility notification part 2004). For example, the remote operation possibility notification part 305 determines whether or not the shovel 100 can be remotely operated by the operator outside the shovel 100, according to whether or not the operator is present in the remote operation room RCR (near the operator's seat ST2).

The remote operation possibility notification part 305 proceeds to step S210 when the operator outside the shovel 100 can remotely operate the shovel 100, otherwise it proceeds to step S212.

In step S210, the remote operation possibility notification part 305 outputs, through the output device 50 in the cabin 10, a notification indicating that there is a possibility of the remote operation of the shovel 100 by the operator outside the shovel 100. For example, as described above, when determining whether or not the operator is present in the remote control room RCR, the remote operation possibility notification part 305 outputs a notification indicating that the operator is present in the remote control room RCR, through the output device 50 in the cabin 10.

On the other hand, in step S212, the remote operation possibility notification part 305 outputs, through the output device 50 in the cabin 10, a notification indicating that there is no possibility of the remote operation of the shovel 100 by the operator outside the shovel 100. For example, as described above, when determining whether or not the operator is present in the remote control room RCR, the remote operation possibility notification part 305 outputs a notification indicating that the operator is absent in the remote control room RCR, through the output device 50 in the cabin 10.

When the process of step S206, step S210, or step S212 is completed, the controller 30 ends the process of the current flowchart.

Note that the process of step S212 may be omitted.

As described above, in the present example, when the remote operation of the shovel 100 is not being performed and there is a possibility of the remote operation of the shovel 100 being performed, the controller 30 can notify the operator in the cabin 10 that there is a possibility of the remote operation of the shovel 100 being performed.

Other Examples

As described above, the controller 30 may include only the remote operation possibility notification part 305 from among the operation status notification part 304 and the remote operation possibility notification part 305.

In this case, the controller 30 omits the processes of steps S204 and S206 in FIG. 10, and proceeds to step S202 when the determination result of step S208 is YES, thereby implementing the processing relating to the implementation status of the remote operation of the shovel 100.

As described above, in the present example, the controller 30 can notify the operator in the cabin 10 that there is a possibility of the remote operation of the shovel 100 being performed in a situation where there is a possibility of the remote operation of the shovel 100 being performed, including a case where the remote operation of the shovel 100 is being performed.

[Notification Process Relating to Implementation Status of Notification Operation of Shovel]

Next, a notification process relating to an implementation status of the normal operation of the shovel 100, which is executed by the remote operation support device 200, will be described with reference to FIGS. 11 and 12.

First Example

Figure 11:
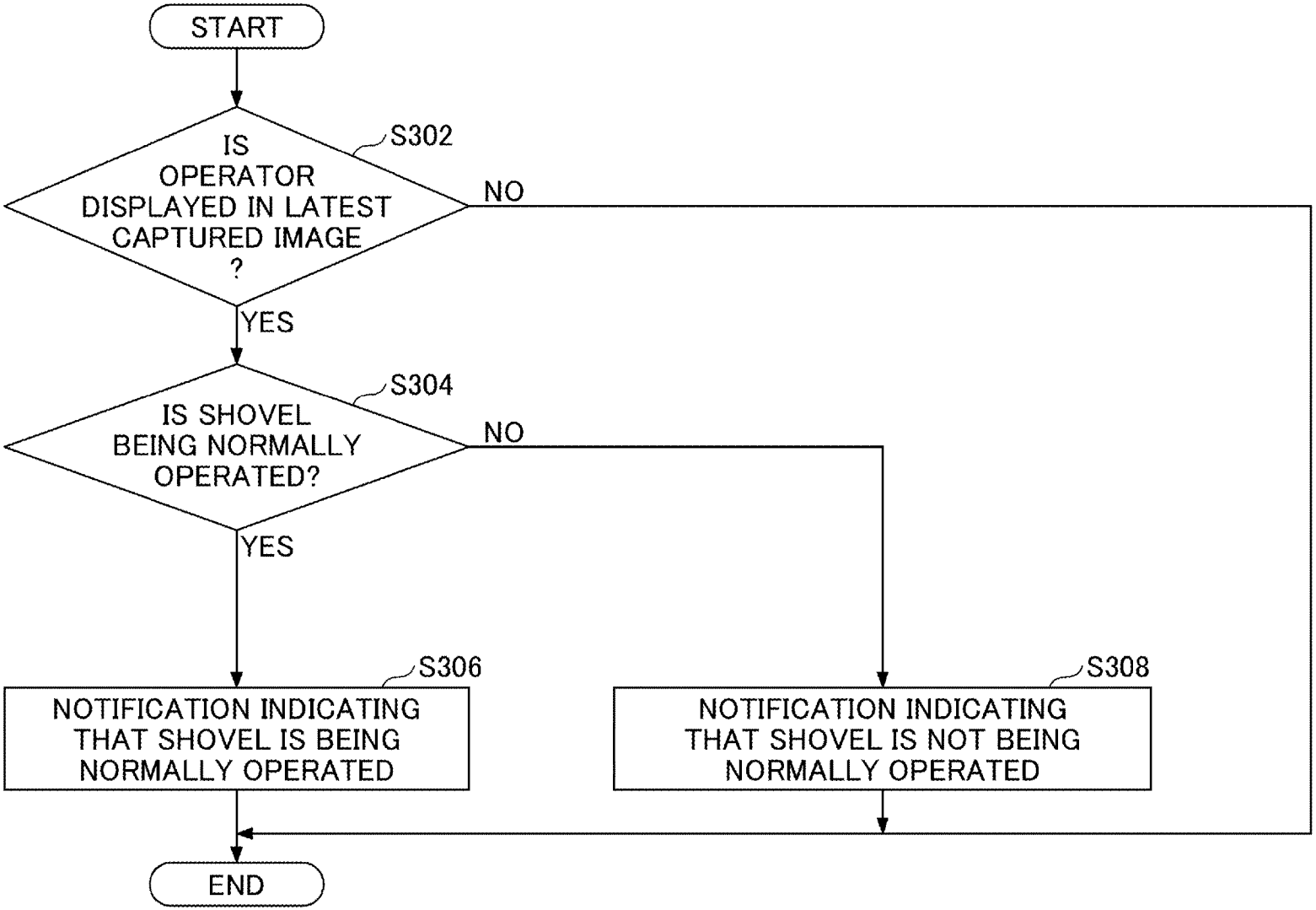
FIG. 11 is a flowchart schematically illustrating a first example of a notification process relating to an implementation status of a normal operation of the shovel.

FIG. 11 is a flowchart schematically illustrating a first example of the notification process relating to the implementation status of the normal operation of the shovel 100.

In this example, a description will be given on the assumption that the remote operation support device 200 includes only the operation status notification part 2002 of the operation status notification part 2002 and the normal operation possibility notification part 2003.

This flowchart is repeatedly executed at predetermined processing intervals, for example, during the operation from the start to the stop of the remote operation support device 200 and during the operation from the start to the stop of the shovel 100. The same applies to the flowchart of FIG. 12.

As illustrated in FIG. 11, in step S302, the remote operation support device 200 determines whether or not the operator is displayed in the latest captured image by the imaging device 205. For example, the remote operation support device 200 determines that the operator is displayed when a predetermined part of a person is recognizable as being included in a predetermined size in a predetermined image region in the latest captured image by the imaging device 205. For example, when the imaging device 205 is installed in the remote control room RCR, the predetermined image region is an image region corresponding to an imaging range indicating the vicinity of the operator's seat ST2. Further, for example, in a case where the imaging device 205 is incorporated in the housing of the portable remote operation support device 200, the predetermined image region corresponds to an image region including the face of the operator who visually recognizes the display device 208 in the captured image by the imaging device 205.

The remote operation support device 200 proceeds to step S304 when the operator is displayed in the latest captured image by the imaging device 205, otherwise it ends the process of the current flowchart.

The process of step S302 may be omitted. The same may apply to step S402 described later.

In step S304, the operation status notification part 2002 determines whether or not the shovel 100 is being normally operated by the operator in the cabin 10. The operation status notification part 2002 proceeds to step S306 when the shovel 100 is being normally operated by the operator in the cabin 10, otherwise it proceeds to step S308.

In step S306, the operation status notification part 2002 outputs a notification indicating that the shovel 100 is being normally operated by the operator in the cabin 10 through the display device 208 or the sound output device 209.

On the other hand, in step S308, the operation status notification part 2002 outputs a notification indicating that the shovel 100 is not being normally operated by the operator in the cabin 10 through the display device 208 or the sound output device 209.

When the process of step S306 or step S308 is completed, the remote operation support device 200 ends the process of the current flowchart.

Note that the process of step S308 may be omitted.

In this way, in the present example, when the normal operation of the shovel 100 is being performed, the remote operation support device 200 can notify the operator outside the shovel 100 that the normal operation of the shovel 100 is being performed.

Second Example

Figure 12:
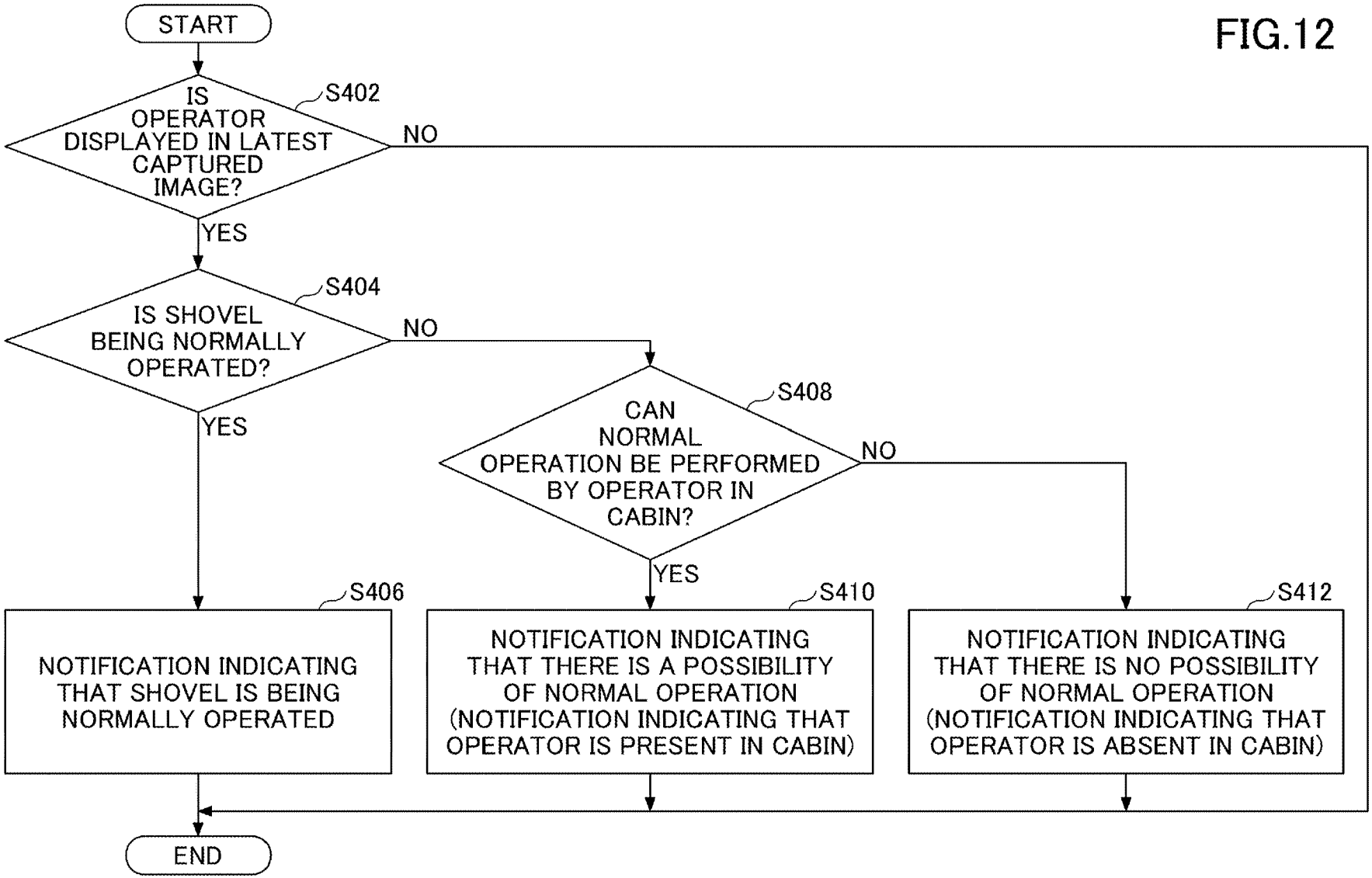
FIG. 12 is a flowchart schematically illustrating a second example of a notification process relating to an implementation status of the normal operation of the shovel.

FIG. 12 is a flowchart schematically illustrating a second example of a notification process relating to an implementation status of the normal operation of the shovel 100.

In this example, a description will be given on the assumption that the remote operation support device 200 includes both the operation status notification part 2002 and the normal operation possibility notification part 2003.

As illustrated in FIG. 12, the processes in steps S402 and S404 are the same as the processes in steps S302 and S304 in FIG. 11, and therefore, the description thereof is omitted.

In step S404, the operation status notification part 2002 proceeds to step S406 when the normal operation of the shovel 100 is being performed by the operator in the cabin 10, otherwise, it proceeds to step S408.

Since the process of step S406 is the same as the process of step S306 of FIG. 11, the description thereof will be omitted.

On the other hand, in step S408, the normal operation possibility notification part 2003 determines whether or not the shovel 100 is in a status in which the normal operation of the shovel 100 can be performed by the operator in the cabin 10, based on the notification signal from the shovel 100 (normal operation possibility notification part 306). For example, the normal operation possibility notification part 2003 determines whether or not the shovel 100 is in the status in which the normal operation can be performed, according to whether or not an operator (person) is in the cabin 10.

The normal operation possibility notification part 2003 proceeds to step S410 when the shovel 100 is in a status in which the normal operation of the shovel 100 can be performed by the operator in the cabin 10, otherwise, it proceeds to step S412.

In step S410, the normal operation possibility notification part 2003 outputs a notification indicating that there is a possibility of the normal operation of the shovel 100 being performed by the operator in the cabin 10, through the display device 208 or the sound output device 209. For example, as described above, when determining whether or not the operator is in the cabin 10, the normal operation possibility notification part 2003 outputs a notification indicating that the operator is present in the cabin 10, through the display device 208 or the sound output device 209.

On the other hand, in step S412, the normal operation possibility notification part 2003 outputs a notification indicating that there is no possibility that the normal operation of the shovel 100 can be performed by the operator in the cabin 10, through the display device 208 or the sound output device 209. For example, as described above, when determining whether or not the operator is in the cabin 10, the normal operation possibility notification part 2003 outputs a notification indicating that the operator is absent in the cabin 10, through the display device 208 or the sound output device 209.

When the process of step S406, step S410, or step S412 is completed, the remote operation support device 200 ends the process of the current flowchart.

Note that the process of step S412 may be omitted.

In this way, in the present example, when the normal operation of the shovel 100 is not being performed and there is a possibility of the normal operation of the shovel 100 being performed, the controller 30 can notify the operator outside the shovel 100 that there is a possibility of the normal operation of the shovel 100 being performed.

Other Examples

As described above, the remote operation support device 200 may include only the normal operation possibility notification part 2003 of the operation status notification part 2002 and the normal operation possibility notification part 2003.

In this case, the remote operation support device 200 omits the processes of steps S404 and S406 of FIG. 12, and proceeds to step S402 when the determination result of step S408 is YES, and thus it is possible to implement the process relating to the implementation status of the normal operation of the shovel 100.

As described above, in the present example, the remote operation support device 200 can notify the operator outside the shovel 100 that there is a possibility of the normal operation of the shovel 100 being performed in a situation in which there is a possibility of the normal operation of the shovel 100 being performed, including a case in which the normal operation of the shovel 100 is being performed.

[Operation]

Next, the operation of the shovel and the remote operation support device according to the present embodiment will be described.

In a status in which a first operator is on board a work machine and is operating the work machine or is about to operate the work machine, the work machine may be remotely operated by a second operator outside the work machine.

For example, the first operator on board the work machine may receive training on how to operate the work machine from the second operator outside the work machine. In this case, there are times when the second operator performs a model operation while the first operator is mainly performing the operation of the work machine.

Further, for example, at a certain point in time, the operation of the work machine may be switched from the first operator on board the work machine to the second operator outside the work machine.

In such a case, when a problem arises in the communication between the first operator and the second operator in a situation where the first operator intends to operate the work machine, the second operator may acquire the operation right to start the operation of the work machine. Then, the work machine is activated by the operation of the second operator at a timing unexpected by the first operator, and the first operator may misunderstand that the work machine is in a serious failure status or the like and fall into a panic status.

In contrast, according to the present embodiment, a work machine includes the actuator, an operator's seat, an operation device, a control part, and a notification part. The work machine is, for example, the shovel 100 described above. The actuator is, for example, the hydraulic actuator HA described above. The operator's seat is, for example, the operator's seat ST1 described above. The operation device is, for example, the above-described operation device 26. The control part is, for example, the controller 30 described above. The notification part is, for example, the output device 50 described above. Specifically, the first operator in the operator's seat performs an input for operating the actuator on the operation device. The first operator is, for example, the operator OP1 described above. The control part activates the actuator in response to either an input of a remote operation from the outside of the work machine or an input to the operation device. The notification part notifies the first operator that the work machine is being remotely operated when the actuator is being activated in response to the input of the remote operation, and/or notifies the first operator that there is a possibility of the work machine being remotely operated when there is a possibility of the actuator being activated in response to the input of the remote operation.

Thus, the work machine can notify the first operator on board the work machine that the work machine is being remotely operated. The work machine can notify the first operator on board the work machine that there is a possibility of the work machine being remotely operated. Therefore, the work machine can cause the first operator on board the work machine to appropriately recognize the operation status of the work machine by the second operator outside the work machine. Therefore, the work machine can prevent a situation where the work machine is activated in association with the operation of the second operator from occurring at a timing that is unexpected by the first operator.

In the present embodiment, the notification part may notify the first operator of at least one of whether or not the work machine is being remotely operated and whether or not there is a possibility of the work machine being remotely operated.

Thus, the work machine can notify not only when the work machine itself is being remotely operated, but also when the work machine itself is not being remotely operated. Further, the work machine can notify the first operator not only when there is a possibility of the work machine itself being remotely operated, but also when there is no possibility of the work machine itself being remotely operated. Therefore, the work machine can cause the first operator on board the work machine to more appropriately recognize the operation status of the work machine by the second operator outside the work machine.

In the present embodiment, when the second operator is at a predetermined location where the second operator can perform an input of a remote operation, the notification part may notify the first operator of the fact. The second operator is, for example, the operator OP2 described above. The predetermined location is near the operator's seat ST2 in remote control room RCR described above. The predetermined location is, for example, a location where the display device 208 can be visually recognized by the above-described portable remote operation support device 200.

Thus, the work machine can make the first operator on board the work machine recognize that the second operator is in a status of being able to perform input of remote control.

In the present embodiment, the notification part may notify the first operator whether or not the second operator is present at the predetermined location.

Thus, the work machine can notify the first operator on board the work machine of not only a case where the second operator can perform input of remote control but also a case where the second operator cannot perform input of remote control. Therefore, the work machine can cause the first operator on board the work machine to more appropriately recognize the operation status of the work machine by the second operator outside the work machine.

In the present embodiment, the notification part may be disposed at a position that can be visually recognized by the first operator, and may display a current captured image of the predetermined location.

Thus, the work machine can cause the second operator to recognize whether or not the second operator is in a status of being able to perform input of remote control, based on the current captured image of the predetermined location.

Further, as in the above, the work machine may be operated by a fourth operator on board the work machine in a state a third operator outside the work machine is remotely operating the work machine or is about to operate the work machine.

For example, the fourth operator on board the work machine may receive training on how to operate the work machine from the third operator outside the work machine. In this case, the third operator may perform a model operation while the fourth operator mainly performs the operation of the work machine.

Further, for example, there is a case where the operation of the work machine is switched from the third operator outside the work machine to the fourth operator on board the work machine at a certain point in time.

In such a case, when a problem arises in the communication between the third operator and the fourth operator in a situation where the third operator intends to remotely operate the work machine, there is a possibility that the fourth operator may acquire the operation right and start the operation of the work machine. When this happens, there is a possibility that the work machine may be operated by the fourth operator at a timing unexpected by the third operator, and the third operator may misunderstand the work machine as being in a serious failure status or the like and fall into a panic state.

In contrast, in the present embodiment, the remote operation support device includes a communication part and a notification part. The remote operation support device is, for example, the remote operation support device 200 described above. The communication part is, for example, the communication interface 206 described above. The notification part is, for example, the display device 208 or the sound output device 209 described above. Specifically, the communication part is provided to communicate with the work machine in which the actuator is operated in response to either an input to an operation device provided near an operator's seat of the work machine or an input of a remote operation from the outside of the work machine. The work machine is, for example, the shovel 100 described above. The operation device is, for example, the above-described operation device 26. The actuator is, for example, the hydraulic actuator HA described above. The notification part notifies the third operator who performs an input of remote operation that the work machine is being operated according to an input to the operation device when the actuator is being operated according to an input to the operation device, and/or notifies the third operator that there is a possibility of the work machine being operated according to the input to the operation device when there is a possibility of the actuator being operated according to the input to the operation device. The third operator is, for example, the operator OP2 described above.

Thus, the remote operation support device can notify the third operator outside the work machine that the work machine is being operated by the fourth operator on board the work machine. The remote operation support device can notify the third operator outside the work machine that there is a possibility of the work machine being operated by the fourth operator on board the work machine. Therefore, the remote operation support device can cause the third operator outside the work machine to appropriately recognize the operation status of the work machine performed by the fourth operator on board the work machine. Therefore, the remote operation support device can prevent a situation in which the work machine is activated in association with the operation of the fourth operator from occurring at a timing unexpected by the third operator.

In the present embodiment, the notification part may notify the third operator of whether or not the work machine is being operated by an input to the operation device and whether or not there is a possibility of the work machine being operated by an input to the operation device.

Thus, the remote operation support device can notify the third operator of not only when the work machine is operated by the fourth operator but also when the work machine is not operated by the fourth operator. Further, the work machine can notify the third operator of not only when there is a possibility of the work machine being operated by the fourth operator, but also when there is no possibility of the work machine being operated by the fourth operator. Therefore, the remote operation support device can cause the third operator outside the work machine to more appropriately recognize the operation status of the work machine by the fourth operator on board the work machine.

In the present embodiment, when the fourth operator is present in the operator's seat, the notification part may notify the third operator of the presence of the fourth operator. The operator's seat is, for example, the operator's seat ST1 described above. The fourth operator is, for example, the operator OP1.

Thus, the remote operation support device notifies the third operator outside the work machine that the fourth operator is in the operator's seat, and thereby can cause the third operator to recognize that the work machine is in a status in which the fourth operator can operate the work machine.

In the present embodiment, the notification part may notify the third operator whether or not the fourth operator is present in the operator's seat.

Thus, the remote operation support device can notify the third operator outside the work machine of not only a case where the fourth operator can perform input to the operation device but also a case where the fourth operator cannot perform input to the operation device. Therefore, the remote operation support device can cause the third operator outside the work machine to more appropriately recognize the operation status of the work machine by the fourth operator on board the work machine.

In the present embodiment, the notification part may be disposed at a position that can be visually recognized by the third operator, and may display the current captured image of the operator's seat.

Thus, the remote operation support device can cause the operator to recognize whether or not the fourth operator is in a status of being able to perform an input to the operation device, based on the current captured image of the operator's seat of the work machine.

Although the embodiments have been described in detail, the present disclosure is not limited to such specific embodiments, and various modifications and alterations can be made within the scope of the gist described in the claims.

What is claimed is:

1. A work machine comprising:

an actuator;

an operator's seat;

an operation device configured to receive an input of an operation to operate the actuator;

processing circuitry configured to activate the actuator according to an input of a remote operation from outside the work machine or the input of the operation to the operation device; and an output device configured to perform at least one of notifying an operator in the operator's seat that the work machine is being remotely operated by a remote operator at a predetermined location outside the work machine when the actuator is being activated according to the input of the remote operation, and notifying the operator in the operator's seat that there is a possibility of the work machine being remotely operated by the remote operator at the predetermined location outside the work machine when there is a possibility of the actuator being activated according to the input of the remote operation.

2. The work machine according to claim 1, wherein the output device is configured to notify the operator in the operator's seat of at least one of whether or not the work machine is being remotely operated by the remote operator and whether or not there is a possibility of the work machine being remotely operated by the remote operator.

3. The work machine according to claim 1, wherein the output device is configured to, when the remote operator is present at the predetermined location, where the remote operator is capable of performing the input of the remote operation, notify the operator in the operator's seat that the remote operator is present at the predetermined location based on a captured image of the predetermined location.

4. The work machine according to claim 3, wherein the output device is configured to notify the operator in the operator's seat of whether or not the remote operator is present at the predetermined location.

5. The work machine according to claim 4, further comprising:

a cabin in which the operator's seat is provided; and an imaging device disposed in the cabin such that a lens of the imaging device faces the operator's seat to include the operator's seat in an imaging range of the imaging device, wherein the output device is disposed in the cabin at a position visible from the operator in the operator's seat and is configured to display a current captured image of the predetermined location.

6. A remote operation support device configured to support a remote operator outside a work machine in remotely operating the work machine, the work machine including an actuator, an operator's seat, and an operation device configured to receive an input of an operation to operate the actuator, the actuator being configured to be operated according to the input of the operation to the operation device or an input of a remote operation from the remote operator, the remote operation support device comprising:

a remote operation device configured to receive the input of the remote operation to remotely operate the actuator of the work machine;

a communication device configured to communicate with the work machine; and an output device configured to perform at least one of notifying the remote operator that the work machine is being operated by an operator in the operator's seat of the work machine when the actuator is being operated according to the input of the operation to the operation device, and notifying the remote operator that there is a possibility of the work machine being operated by the operator in the operator's seat of the work machine when there is a possibility of the actuator being operated according to the input of the operation to the operation device.

7. The remote operation support device according to claim 6, wherein the output device is configured to notify the remote operator of whether or not the work machine is being operated by the operator in the operator's seat of the work machine and whether or not there is a possibility of the work machine being operated by the operator in the operator's seat of the work machine.

8. The remote operation support device according to claim 6, wherein the output device is configured to, when the operator is present in the operator's seat, notify the remote operator of the presence of the operator based on a captured image of the operator's seat of the work machine.

9. The remote operation support device according to claim 8, wherein the output device is configured to notify the remote operator in the remote operator's seat of whether or not the operator is present in the operator's seat of the work machine.

10. The remote operation support device according to claim 9, further comprising:

an imaging device in a remote operation room in which a remote operator's seat is provided, the imaging device being disposed such that a lens of the imaging device faces the remote operator's seat to include the remote operator's seat in an imaging range of the imaging device, wherein the output device is disposed in the remote operation room at a position visible from the remote operator in the remote operator's seat, and is configured to display a current captured image of the operator's seat of the work machine.

* * * * *